US007009483B2

(12) United States Patent
Takeyama et al.

(10) Patent No.: US 7,009,483 B2
(45) Date of Patent: Mar. 7, 2006

(54) IGNITION COIL DEVICE AND METHOD OF MANUFACTURING THE SAME

(75) Inventors: Shouichi Takeyama, Hashima (JP); Kazuhide Kawai, Kariya (JP); Masahiko Aoyama, Kariya (JP); Hideyuki Kato, Nishio (JP)

(73) Assignee: Denso Corporation, (JP)

( * ) Notice: Subject to any disclaimer, the term of this patent is extended or adjusted under 35 U.S.C. 154(b) by 56 days.

(21) Appl. No.: 10/726,889

(22) Filed: Dec. 4, 2003

(65) Prior Publication Data

US 2004/0108931 A1 Jun. 10, 2004

(30) Foreign Application Priority Data

Dec. 5, 2002 (JP) ..... 2002-354040
Aug. 5, 2003 (JP) ..... 2003-286826
Oct. 31, 2003 (JP) ..... 2003-373130

(51) Int. Cl.
*H01F 27/02* (2006.01)

(52) U.S. Cl. ..... 336/96

(58) Field of Classification Search ..... 336/65, 336/83, 90–96, 107, 192, 198; 123/634–635
See application file for complete search history.

(56) References Cited

U.S. PATENT DOCUMENTS 5,977,856 A * 11/1999 Maekawa et al. ..... 336/96
6,332,458 B1 * 12/2001 Shimada et al. ..... 123/634
6,417,752 B1 7/2002 Heritier-Best et al.

* cited by examiner

*Primary Examiner*—Tuyen T Nguyen
(74) *Attorney, Agent, or Firm*—Nixon & Vanderhye PC

(57) ABSTRACT

An ignition coil device has a secondary spool, a secondary coil wound around the secondary spool, an insulating resin material that is filled into spaces between the secondary windings, a primary spool, a primary coil wound around the primary spool, a connector that is arranged on one end side in an axial direction of these parts and has a connector terminal electrically connected to the primary coil and the secondary coil, and a resin insulting material for connector that is filled into the connector. The base material of the coil insulating resin material is the same as or different from the base material of the connector insulating resin material.

26 Claims, 13 Drawing Sheets

IGNITION COIL DEVICE AND METHOD OF MANUFACTURING THE SAME

CROSS REFERENCE TO RELATED APPLICATION

This application is based on and incorporates herein by reference Japanese Patent Applications No. 2002-354040 filed on Dec. 5, 2002, No. 2003-286826 filed on Aug. 5, 2003, and No. 2003-373130 filed on Oct. 31, 2003.

FIELD OF THE INVENTION

The present invention relates to a stick-type ignition coil device directly mounted in a plug hole of an internal combustion engine and a method of manufacturing the same.

BACKGROUND OF THE INVENTION

An ignition coil device in which an insulating resin material is vacuum-filled into the whole of a housing is disclosed as a stick-type ignition coil device in U.S. Pat. No. 6,417,752 (JP-2001-185430A). An axial cross-sectional view of an ignition coil device of the same type as the ignition coil device disclosed in the above patent document is shown in FIG. 13. As shown in this figure, an ignition coil device 100 has a center core 101, a secondary spool 102, a secondary coil 103, a primary spool 104, a primary coil 105, an outer peripheral core 106, a housing 107, and a high voltage tower 108.

The housing 107 is shaped like a cylinder. The center core 101 is shaped like a round bar and is arranged nearly in the radial center of the housing 107. The secondary spool 102 is cylindrical and is arranged on the outer peripheral side of the center core 101. The secondary coil 103 is wound around the outer peripheral surface of the secondary spool 102. The primary spool 104 is cylindrical and is arranged on the outer peripheral side of the secondary coil 103. The primary coil 105 is wound around the outer peripheral surface of the primary spool 104. The outer peripheral core 106 is shaped like a cylinder with a slit and is arranged on the outer peripheral side of the primary coil 105. The high voltage tower 108 covers the bottom end opening of the housing 107.

An insulating resin material 109 is epoxy resin and is filled from the top end opening of the housing 107 into the housing 107 and the high voltage tower 108 which are evacuated to a vacuum. The insulating resin material 109 is cured in the spaces between the respective parts.

The above ignition coil device 100 is manufactured in the following manner. First, the center core 101, the secondary spool 102, the secondary coil 103, the primary spool 104, the primary coil 105 and the outer peripheral core 106 are mounted in the housing 107 and The bottom end opening of the housing 107 is closed by the high voltage tower 108. A case having a top end opening is formed by the housing 107 and the high voltage tower 108. Next, the insulating resin material 109 is vacuum-filled at a time from the top opening of the housing 107. The insulating resin material 109 is filled into the spaces between the respective parts described above. The insulating resin material 109 is cured in the spaces between the respective parts.

Here, the insulating resin material 109 is filled so as to fix the respective parts constructing the ignition coil device 100. The insulating resin material 109 is filled so as to secure the insulation between the respective parts.

However, the ignition coil device 100 has portions which need to be insulated and fixed and has portions which do not need to be insulated but is good enough to be fixed. Moreover, the ignition coil device 100 has portions which do not need to be insulated and fixed, that is, which do not need be filled itself of the insulating resin material 109.

However, according to the above method of manufacturing the ignition coil device 100, the insulating resin material 109 is filled into the whole of the ignition coil device 100. Namely, although the needs of the respective parts of the ignition coil device 100 for the insulating resin material 109 are different from each other, the same insulating resin material 109 is distributed to all of the parts. For this reason, there is no other choice but to use a resin material having an excellent insulating property and a fixing property as the insulating resin material 109. Hence, this results in increasing the cost of the insulating resin material 109 and the manufacturing cost of the ignition coil device 100 itself.

SUMMARY OF THE INVENTION

It is therefore one object of the invention to provide an ignition coil device capable of reducing manufacturing cost.

It is another object of the invention to provide a simple method of manufacturing this ignition coil device.

Ignition coil device in accordance with the invention is characterized in that the base material of such a coil insulating resin material that is filled into spaces between secondary windings is the same as or different from the base material of such an insulating resin material for a connector that is connected to a primary coil and the secondary coil. That is, the ignition coil device in accordance with the invention has two different insulating resin materials of the coil insulating resin material and the connector insulating resin material.

Since the secondary windings have a high voltage applied thereto, the windings need to be surely insulated from each other. The secondary windings need to be insulated from the primary coils. The secondary coil is wound, for example, in a slanting direction around the outer peripheral surface of the secondary spool. For this reason, it is necessary to prevent the secondary windings from losing its winding shape. In this manner, the insulating resin material filled into the spaces between the secondary windings needs to have an insulating property and a fixing property.

On the other hand, parts such as a connector terminal are received in the connector. For this reason, the resin insulting material filled into the connector needs to have mainly the fixing property.

The ignition coil device in accordance with the invention is manufactured by filling an insulating resin material having properties responsive to these needs into the spaces between the secondary windings and into the connector. That is, a coil insulating resin material that is excellent in the insulating property and in the fixing property is filled into the spaces between the secondary windings. A connector insulating resin material that is excellent in the fixing property is filled into the connector.

The connector insulating resin material does not necessarily have as high an insulating property as the coil insulating resin material has. For this reason, according to the ignition coil device of the invention, it is possible to reduce cost involving with the connector insulating resin material. Thus, it is possible to reduce the manufacturing cost of the ignition coil device.

Here, the base material of the connector insulating resin material may be the same as or different from the base material of the coil insulating resin material. Moreover, the connector insulating resin material may be molded integrally with or separately from the coil insulating resin material. In a case where the connector insulating resin material is molded integrally with the coil insulating resin material, its property may gradually vary from the connector insulating resin material to the coil insulating resin material.

It is more preferable to construct the ignition coil device in such a way that the coil insulating resin material and the connector insulating resin material be separately arranged from each other. That is, in this construction, the coil insulating resin material is separately arranged from the connector insulating resin material. According to this construction, the properties of both insulating resin materials can be easily controlled.

It is more preferable to construct the ignition coil device in such a way that no insulating resin material is filled except for the coil insulating resin material and the connector insulating resin material. According to this construction, no insulating resin material is filled into portions which are not necessarily required to be insulated and fixed, for example, the spaces between the primary coils. For this reason, it is possible to reduce the amount of use of insulating resin material and hence to reduce the manufacturing cost of the ignition coil device.

It is more preferable to construct the ignition coil device in such a way that the percentage of content of voids of the connector insulating resin material is higher than the percentage of content of voids of the coil insulating resin material. Here, the percentage of content of voids means the percentage of voids relative to the insulating resin material in a cross section perpendicular to the axial direction of the ignition coil device. If the percentage of content of voids is higher, the insulating property of the insulating resin material becomes worse. Thus, if the percentage of content of voids is higher, it is difficult to ensure insulation. However, the insulating property is not as important in the connector as in the secondary coil. Namely, it is essential in the connector only that the connector can fix the respective parts received in the connector. In view of these facts, in this construction, the percentage of content of voids of the connector insulating resin material is intentionally set at a higher value than the percentage of content of voids of the coil insulating resin material.

According to this construction, the net amount of use of the connector insulating resin material can be reduced by the higher percentage of content of voids. For this reason, the manufacturing cost of the ignition coil device can be reduced. Then, in some cases, the coil insulating resin material needs, for example, a work for removing the voids, but the connector insulating resin material does not need such a work. Thus, the ignition coil device can be easily mounted.

It is more preferable to construct the ignition coil device in such a way that at least one of the base material of the coil insulating resin material and the base material of the coil insulating resin material is epoxy resin. According to this construction, the heat resistance, insulating property, and mechanical strength of the coil insulating resin material and the connector insulating resin material can be ensured comparatively easily.

Here, the kind of epoxy resin is not especially limited in its kind. Aromatic epoxy resin and cyclic fatty epoxy resin can be used. It is bisphenolic epoxy resin that is preferably used among the aromatic epoxy resins. Among the bisphenolic epoxy resins can be especially preferably used bisphenol A-type epoxy resin, bisphenol F-type epoxy resin, and bisphenol S-type epoxy resin. This is because these are inexpensive and excellent in heat resistance, insulating property and mechanical strength. In this construction, by using one of these various kinds of epoxy resins or by combining a plurality of kinds of them, it is possible to comparatively easily ensure the fixing property and the insulating property necessary for the coil insulating resin material and the fixing property necessary for the connector insulating resin material.

It is more preferable to construct the ignition coil device in such a way that fillers are distributed in the base material of the coil insulating resin material and in the base material of the connector insulating resin material, and that the percentage of content of the fillers relative to the base material of the connector insulating resin material is higher than the percentage of content of the fillers relative to the base material of the coil insulating resin material.

The coil insulating resin material needs be impregnated into fine spaces between the secondary windings. For this reason, it is preferable that the fluidity of the coil insulating resin material is high. In contrast to this, it is preferable that the connector insulating resin material remains in the connector until the resin is cured after filling. For this reason, it is preferable that the fluidity of the connector insulating resin material is low. In this manner, the secondary coil and the connector are opposite to each other in the needs for fluidity. For this reason, in a case where only the same insulating resin material is filled into the spaces between the secondary windings and the connector, it is difficult to satisfy both of the needs opposite to each other.

In contrast to this, this construction has two kinds of insulating resin materials of the coil insulating resin material and the connector insulating resin material. The fluidity of the coil insulating resin material and the fluidity of the connector insulating resin material are adjusted by the percentage of content of fillers relative to the base material thereof. According to this construction, the fluidity of the coil insulating resin material can be made higher. For this reason, the coil insulating resin material can be distributed to all spaces between the secondary windings. Moreover, the fluidity of the connector insulating resin material can be made lower. For this reason, the connector insulating resin material can be made to remain in the connector until it is cured after filling.

In some case, an igniter (electronic circuit device) is arranged in the connector. The coefficient of linear expansion of resin forming the outside shape of this igniter (resin for igniter) is smaller than the coefficient of linear expansion of the coil insulating resin material. Thus, it is preferable that the coefficient of linear expansion of the connector insulating resin material is smaller than the coefficient of linear expansion of the coil insulating resin material. That is, it is preferable that the coefficient of linear expansion of the resin for igniter is close to the coefficient of linear expansion of the connector insulating resin material.

Here, in order to reduce the coefficient of linear expansion, it is recommended to increase the percentage of content of fillers relative to the base material. In this point, the percentage of content of fillers relative to the base material of the connector insulating resin material in accordance with this construction is higher than the percentage of content of filler to the base material of the coil insulating resin material. Thus, according to this construction, it is possible to prevent a thermal stress from being produced in the connector by a difference in the coefficient of linear expansion.

Moreover, if the coil insulating resin material includes the fillers, the difference in the coefficient of linear expansion between the coil insulating resin material and the secondary windings becomes small. For this reason, it is possible to prevent a thermal stress from being produced in the spaces between the secondary windings by a difference in the coefficient of linear expansion. Thus, it is possible to prevent cracks and dielectric breakdown from being produced in the coil insulating resin material by the thermal stress.

It is more preferable to construct the ignition coil device in such a way that the percentage of content of the fillers of the connector insulating resin material is 55% or more by weight in a case where the whole connector insulating resin material is 100% by weight, and that the percentage of content of the fillers of the coil insulating resin material is less than 55% by weight in a case where the whole coil insulating resin material is 100% by weight.

The reason why the percentage of content of the fillers of the connector insulating resin material is 55% or more by weight is because the connector insulating resin material having the percentage of content of 55% or more by weight can more reliably remain in the connector until it is cured after filling.

Further, the reason why the percentage of content of the fillers of the coil insulating resin material is less than 55% by weight is because the coil insulating resin material having the percentage of content of less than 55% by weight can be more reliably distributed to all the spaces between the secondary windings.

It is more preferable to construct the ignition coil device in such a way that in the above construction, the filler is an inorganic filler comprising one element selected from the group consisting of crystalline silica, mica, talc, fused silica, and alumina. These inorganic fillers can be used alone or in combination of a plurality of kinds of fillers. The inorganic filler has excellent heat resistance. For this reason, according to this construction, it is possible to improve the heat resistance of the coil insulating resin material and the connector insulating resin material.

Here, in order to make a check on the percentage of content of the inorganic filler, for example, it is recommended that the coil insulating resin material or the connector insulating resin material obtained by sampling the ignition coil device be heated in air to incinerate parts other than the inorganic filler and that the percentage of remaining inorganic filler be measured.

It is more preferable to construct the ignition coil device in such a way that fillers are distributed in the base material of the coil insulating resin material and the base material of the connector insulating resin material, and that the fillers of the connector insulating resin material are large in size than the fillers of the coil insulating resin material.

As described above, it is preferable that the fluidity of the coil insulating resin material is high. In contrast, it is preferable that the fluidity of the connector insulating resin material is low. This construction is to adjust the fluidity of the coil insulating resin material and the fluidity of the connector insulating resin material by the sizes of the fillers. According to this construction, it is possible to increase the fluidity of the coil insulating resin material. For this reason, it is possible to distribute the coil insulating resin material to all the spaces between the secondary windings. According to this construction, it is possible to decrease the fluidity of the connector insulating resin material. For this reason, it is possible to make the connector insulating resin material remain in the connector until it is cured after filling.

It is more preferable to construct the ignition coil device in such a way that the fillers are inorganic fillers comprising one element selected from the group consisting of crystalline silica, mica, talc, fused silica, and alumina. As described above, these inorganic fillers can be used alone or in combination of a plurality of kinds of fillers. The inorganic filler is excellent in heat resistance. For this reason, according to this construction, it is possible to improve the heat resistance of the coil insulating resin material and the connector insulating resin material.

It is more preferable to construct the ignition coil device in such a way that the fillers are diffused only in the base material of the connector insulating resin material. As described above, it is preferable that the fluidity of the coil insulating resin material is high. In contrast, it is preferable that the fluidity of the connector insulating resin material is low. This construction is to adjust the fluidity of the coil insulating resin material and the connector insulating resin material by the presence or absence of the fillers. According to this construction, it is possible to increase the fluidity of the coil insulating resin material.

For this reason, it is possible to distribute the coil insulating resin material to all the spaces between the secondary windings. According to this construction, it is possible to decrease the fluidity of the connector insulating resin material. For this reason, it is possible to make the connector insulating resin material remain in the connector until it is cured after filling.

It is more preferable to construct the ignition coil device in such a way that the fillers are inorganic fillers comprising one element selected from the group consisting of crystalline silica, mica, talc, fused silica, and alumina. As described above, these inorganic fillers can be used alone or in combination of a plurality of kinds of fillers. The inorganic filler is excellent in heat resistance. For this reason, according to this construction, it is possible to improve the heat resistance of the coil insulating resin material and the connector insulating resin material.

It is more preferable to construct the ignition coil device in such a way that the coefficient of linear expansion of the connector insulating resin material is smaller than the coefficient of linear expansion of the coil insulating resin material. As described above, in some case, the igniter is arranged in the connector. The coefficient of linear expansion of the resin for the igniter is smaller than the coefficient of linear expansion of the coil insulating resin material. According to this construction, it is possible to bring the coefficient of linear expansion of the connector insulating resin material closer to the coefficient of linear expansion of the resin for the igniter as compared with a case where the coefficient of linear expansion of the connector insulating resin material is equal to the coefficient of linear expansion of the coil insulating resin material. For this reason, it is possible to prevent a thermal stress produced by the difference in the coefficient of linear expansion.

Here, in order to make the coefficient of linear expansion of the connector insulating resin material smaller than the coefficient of linear expansion of the coil insulating resin material, it is recommended, for example, to make the percentage of content of fillers relative to the base material of the connector insulating resin material higher than the percentage of content of fillers relative to the base material of the coil insulating resin material.

It is more preferable to construct the ignition coil device in such a way that the coefficient of linear expansion of the connector insulating resin material is not less than 11 ppm/° C. and less than 40 ppm/° C. The coefficient of linear expansion of a typical insulating resin material for the igniter is 11 ppm/° C. The coefficient of linear expansion of a typical coil insulating resin material is 40 ppm/° C. Hence, in this construction, the coefficient of linear expansion of the connector insulating resin material is adjusted to a value not less than 11 ppm/° C. and less than 40 ppm/° C. According to this construction, it is possible to bring the coefficient of linear expansion of the connector insulating resin material closer to the coefficient of linear expansion of the resin for the igniter. For this reason, it is possible to prevent a thermal stress produced by the difference in the coefficient of linear expansion. Here, in order to adjust the coefficient of linear expansion of the connector insulating resin material, as described above, it is recommended to change the percentage of content of fillers relative to the base material.

It is more preferable to construct the ignition coil device in such a way that the Young's modulus of the connector insulating resin material is smaller than the Young's modulus of the coil insulating resin material. As described above, in some case, the igniter is arranged in the connector. According to this construction, the igniter is surrounded by the soft connector insulating resin material having a low Young's modulus. For this reason, the shock resistance of the igniter is increased as compared with a case where the igniter is surrounded by the connector insulating resin material having a Young's modulus equal to the Young's modulus of the coil insulating resin material.

Here, in order to make the Young' modulus of the connector insulating resin material smaller than the Young' modulus of the coil insulating resin material, for example, just as with the above construction, it is recommended to make the percentage of content of voids of the connector insulating resin material higher than the percentage of content of voids of the coil insulating resin material.

It is more preferable to construct the ignition coil device in such a way that the Young's modulus of the connector insulating resin material is less than 8200 MPa. The Young's modulus of a typical coil insulating resin material is 8200 MPa. In this construction, the Young's modulus of the connector insulating resin material is made less than 8200 MPa. According to this construction, the shock resistance of the igniter is increased. Here, in order to adjust the Young's modulus of the connector insulating resin material, as described above, it is recommended to change the percentage of content of voids.

Moreover, it is also recommended to use the connector insulating resin material whose Young's modulus is less than 8200 MPa.

It is more preferable to construct the ignition coil device in such a way that the igniter is arranged in the connector insulating resin material. According to this construction, it is possible to reduce parts in number as compared with a case where the igniter is arranged separately from the ignition coil device. Then, it is possible to securely fix the igniter.

It is more preferable to construct the ignition coil device in such a way that the igniter is held by a connector terminal and is positioned in the connector insulating resin material. Namely, according to this construction, when the connector insulating resin material is filled, the igniter is held by the connector terminal. That is, the igniter is held by a part for connecting the igniter and the connector terminal. According to this construction, it is possible to reduce parts in number as compared with a case where another part for holding the igniter is arranged. Moreover, this construction can reduce obstacles in number when the connector insulating resin material is filled.

It is more preferable to construct the ignition coil device in such a way that in the above construction, the igniter is positioned in the connector insulating resin material by a protrusion formed on the top of a holder for centering the secondary spool. According to this construction, it is possible to more securely hold the igniter.

Further, a method of manufacturing an ignition coil device in accordance with the invention includes a step of filling the coil insulating resin material into spaces between the secondary windings and a step of filling the connector insulating resin material into the connector. That is, it is possible to comparatively easily manufacture an ignition coil device having both of the coil insulating resin material and the connector insulating resin material.

It is more preferable to construct the method of manufacturing an ignition coil device in such a way that in the above construction, the kinematic viscosity of the connector insulating resin material at the time of filling is higher than the kinematic viscosity of the coil insulating resin material at the time of filling.

As described above, it is preferable that the fluidity of the coil insulating resin material is high, whereas it is preferable that the fluidity of the connector insulating resin material is low. This construction is to adjust the fluidity of the coil insulating resin material and the fluidity of the connector insulating resin material by the kinematic viscosity at the time of filling. According to this construction, the fluidity of the coil insulating resin material can be increased. For this reason, it is possible to distribute the coil insulating resin material into all the spaces between the secondary windings. The fluidity of the connector insulating resin material can be decreased. For this reason, it is possible to make the connector insulating resin material remain in the connector until it is cured after filling.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

The preferred embodiments of an ignition coil device of the invention and the method of manufacturing the same will be described below.

(First Embodiment)

Figure 1:
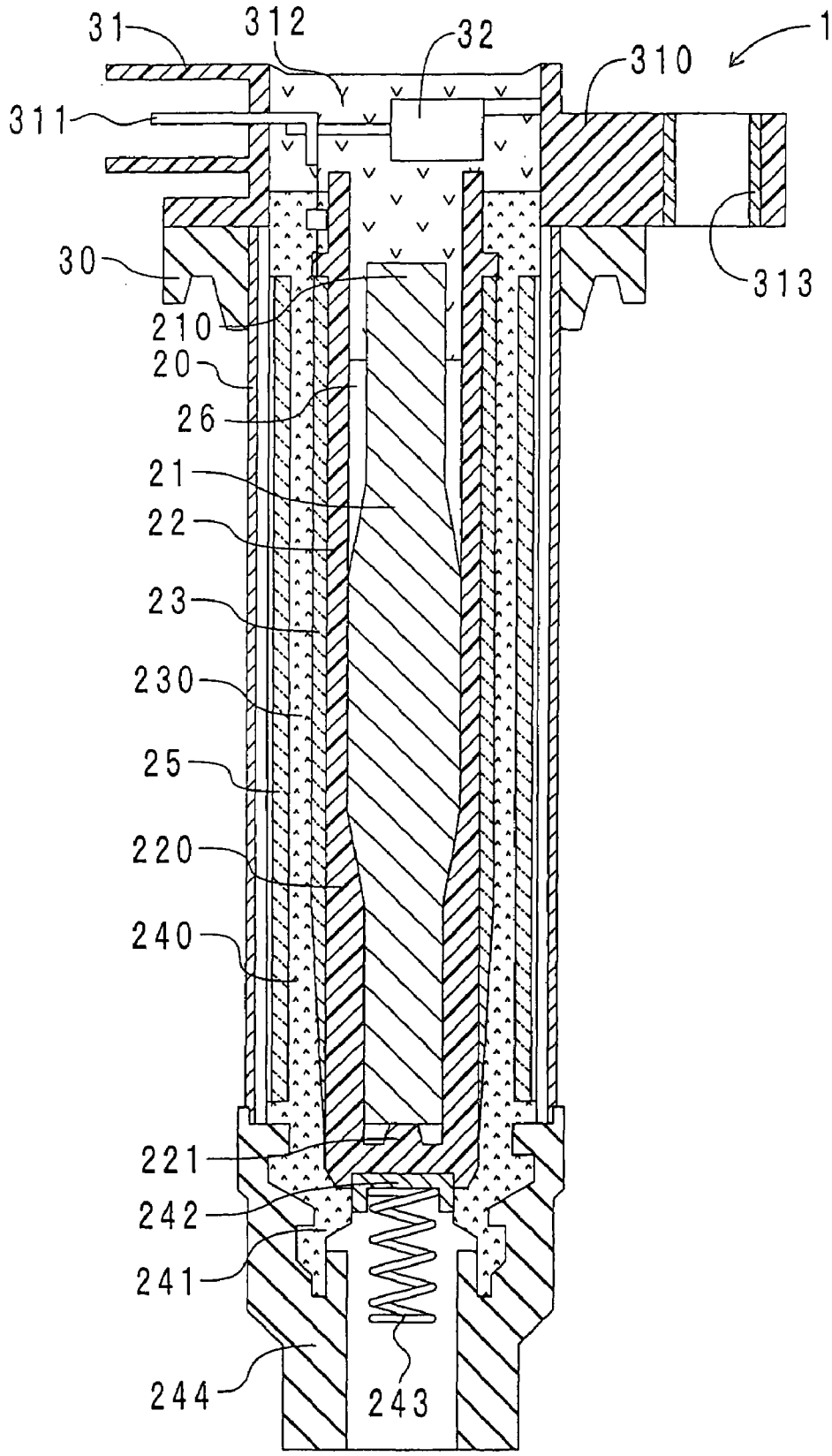
FIG. 1 is an axial cross-sectional view of an ignition coil device in accordance with a first embodiment of the present invention.

First, the construction of the ignition coil device of the present embodiment will be described. An axial cross-sectional view of an ignition coil device of this embodiment is shown in FIG. 1. A stick-type ignition coil device 1 is stored in a plug hole (not shown) formed for each cylinder on the top of an engine block. The ignition coil device 1, as will be described below, is connected to an ignition plug (not shown) on the lower side in the figure.

The outer peripheral core 20 is made of a silicon steel plate and is shaped like a cylinder having a slit (not shown) formed through in a longitudinal direction. A center core 21, a secondary spool 22, a secondary coil 23, a primary spool 240 and a primary coil 25 are stored in the inner peripheral side of the outer peripheral core 20. Each of the coils 23 and 25 are composed of a plurality of windings.

The center core 21 is manufactured by putting magnetic particles in a core mold and then by compressing the magnetic particles under conditions of a predetermined temperature and a predetermined pressure. The center core 21 is shaped like a round bar which is expanded in diameter at the center in a vertical direction.

The secondary spool 22 is molded out of resin and in the shape of a cylinder closed at an end. The secondary spool 22 is arranged on the outer peripheral side of the center core 21. The secondary spool 22 has a secondary spool body 220 and a bottom portion 221.

The secondary spool body 220 is shaped like a cylinder. The shape from the center to the bottom of the inner peripheral surface of the secondary spool body 220 is formed in a shape just symmetric with respect to a mold to the shape from the center to the bottom of the outer peripheral surface of the center core 21 opposed thereto. Hence, a portion below the center of the outer peripheral surface of the center core 21 abuts against and is held by the inner peripheral surface of the secondary spool body 220.

The bottom portion 221 closes the bottom end opening of the secondary spool body 220. The bottom portion 221 is formed in a protruding shape. The bottom end portion of the center core 21 is held by the bottom portion 221.

A cylindrical space 26 is formed between the upper portion of the outer peripheral surface of the center core 21 and the upper portion of the inner peripheral surface of the secondary spool body 220. The secondary coil 23 is wound around the outer peripheral surface of the secondary spool body 220. A coil insulating resin material 230 is impregnated into and is cured in the spaces formed between the wound secondary windings 23. The coil insulating resin material 230 is made of injection molding epoxy resin. The base material of this injection molding epoxy resin is epoxy resin.

The primary spool 240 is integrally molded out of the same injection molding epoxy resin as the coil insulating resin material 230. The primary spool 240 is molded in the shape of a cylinder and is arranged on the outer peripheral side of the secondary windings 23. The primary wiring 25 is wound around the outer peripheral surface of the primary spool 240. Here, the spaces between the primary coils 25 are not impregnated with the resin.

The high voltage tower 241 is integrally mold out of the same injection molding epoxy resin as the primary spool 240 and the coil insulating resin material 230. The high voltage tower 241 closes the bottom end opening of the primary spool 240. The high voltage tower 241 surrounds the bottom portion 221 of the secondary spool 22.

A high voltage terminal 242, which is made of metal and is open downward and is formed in the shape of a cup, is placed nearly in the center of the high voltage tower 241. The high voltage terminal 242 is electrically connected to the secondary coil 23. A coil spring 243 made of metal is fixed to the cup bottom wall of the high voltage terminal 242. An ignition plug is in elastic contact with the coil spring 243. The nearly whole surface of the high voltage tower 241 is covered with a plug cap 244 made of rubber. The ignition plug is pressed into the inner peripheral side of this plug cap 244. The bottom of the outer peripheral core 20 is put into the top of the plug cap 244.

On the other hand, a seal ring 30 made of rubber is annularly put on the top of the outer peripheral core 20. The seal ring 30 is in elastic contact with the edge of the entry of a plug hole. A connector 31 is placed on the seal ring 30. The connector 31 includes a case 310 and a plurality of connector pins 311. Here, the connector pins 311 are included in the connector terminal. The case 310 is molded out of resin and in the shape of an angular cylinder. An igniter 32 is arranged in the case 310. The igniter 32 has a power transistor (not shown), a hybrid integrated circuit (not shown) and a heat sink (not shown) formed therein and sealed with a mold resin.

A collar 313 made of metal into which a bolt (not shown) for fixing the ignition coil device 1 is inserted into the case 310. The connector pins 311 are made of metal and are inserted into the case 310. The connector pins 311 are passed through the case 310 from inside to outside. The ends at the inside of the case 310 of the connector pins 311 are electrically connected to the secondary coil 23, the primary coil 25, and the igniter 32. On the other hand, the ends at the outside of the case 310 of the connector pins 311 are electrically connected t an ECU (engine control unit, not shown). The case 310 is filled with a connector insulating resin material 312. The connector insulating resin material 312 is made of epoxy resin. The base material of this epoxy resin is epoxy resin. That is, both of the base material of the connector insulating resin material 312 and the base material of the coil insulating resin material 230 are epoxy resin. However, the percentage of content of void of the connector insulating resin material 312 is made higher than the percentage of content of void of the coil insulating resin material 230.

The connector insulating resin material 312 grips the top end portion 210 of the center core 21. The connector insulating resin material 312 closes the top end of the space 26.

Next, an operation at the time of flow of electric current through the ignition coil device 1 of this embodiment will be described. A control signal from an ECU (not shown) is transmitted through the connector pins 311 to the igniter 32. When the igniter 32 supplies or stops the current, a predetermined voltage is generated on the primary coils 25 by a self-induction. This voltage is elevated by the mutual induction of the primary coils 25 and the secondary windings 23. The high voltage elevated by the mutual induction is transmitted from the secondary windings 23 through the high voltage terminal 242 and the coil spring 243 to the ignition plug. This high voltage generates a spark in the gap of the ignition plug.

Next, a method of manufacturing the ignition coil device 1 in accordance with this embodiment will be described. The method of manufacturing the ignition coil device 1 in accordance with this embodiment includes a step of filling the insulating resin material into the spaces between the windings and a step of filling the insulating resin material into the connector.

Figure 2:
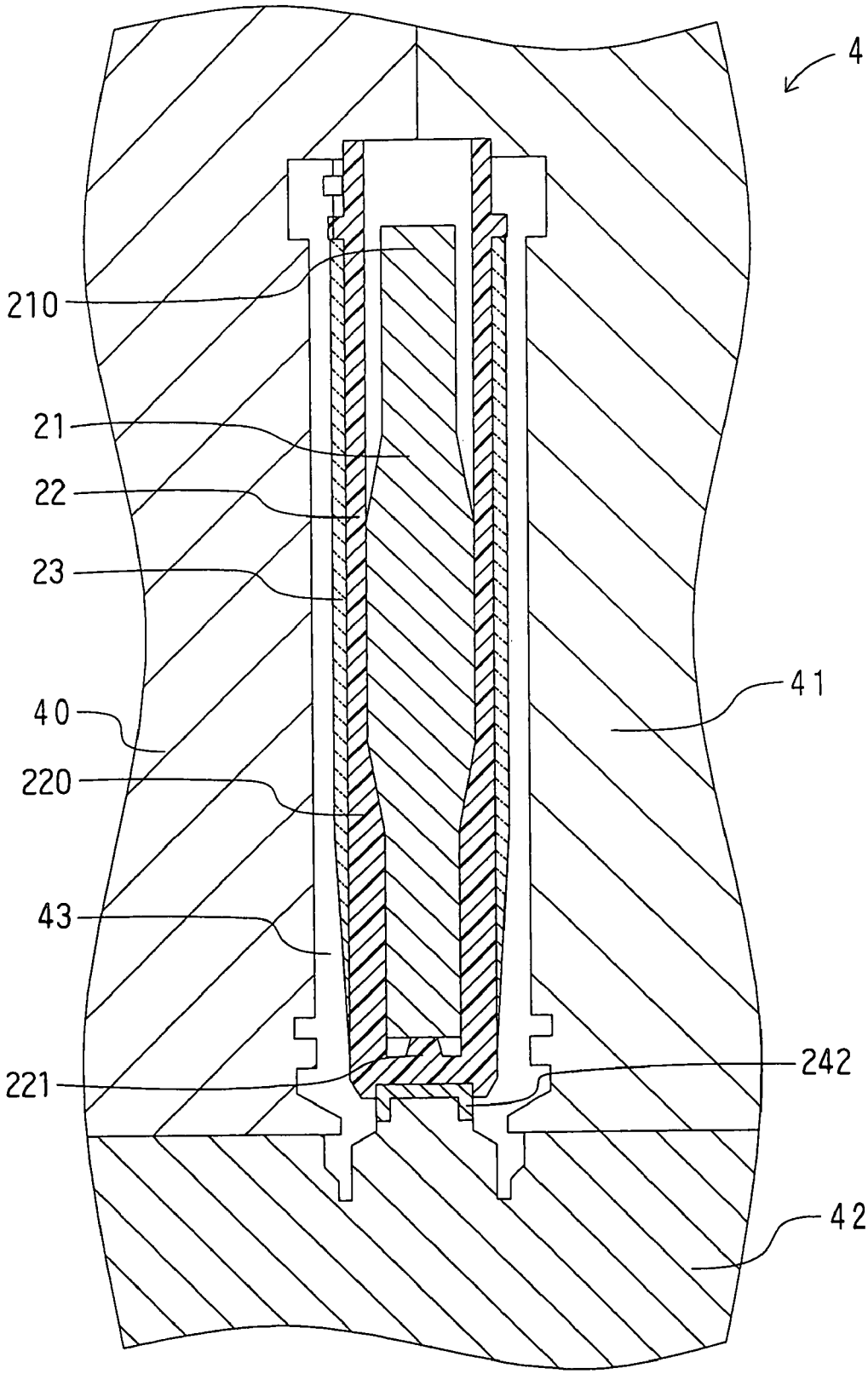
FIG. 2 is an axial cross-sectional view of a mold used in accordance with the first embodiment.

In the step of filling the insulating resin material into the spaces between the windings, first, the secondary spool is arranged in the cavity of a mold. An axial cross-sectional view of the mold is shown in FIG. 2. As shown in FIG. 2, a mold 4 includes a first mold 40, a second mold 41 and a third mold 42. The inside surface of the mold 4 is formed in a shape symmetric with respect to the mold to the outside surfaces of the primary spool and the high voltage tower. The secondary spool 22 previously injection-molded is arranged in the cavity 43 of the mold 4. The secondary coil 23 is wound around the outer peripheral surface of the spool body 220. The high voltage terminal 242 supported by the third mold 42 is fitted in the depressed portion of the bottom end of the bottom portion 221. The high voltage terminal 242 is previously connected to the secondary coil 23. The center core 21 previously formed by compression is inserted into the inner peripheral side of the secondary spool 22.

The bottom of the secondary spool 22 is supported by the third mold 42 via the high voltage terminal 242. On the other hand, the top of the secondary spool 22 is sandwiched between the first mold 40 and the second mold 41. In this manner, the secondary spool 22 is fixed in the cavity 43.

In this step, next, the previously prepared injection molding epoxy resin is filled into the cavity 43 from the nozzle of an injection molding machine through a gate (not shown) which is open in the top of the cavity 43. The injection molding epoxy resin is distributed to all portions in the cavity 43 by injection pressure. At this time, the injection molding epoxy resin is impregnated also into the spaces between the secondary windings 23. Next, the cavity 43 is heated and is held at a predetermined temperature. The cavity 43 is cooled. The injection molding epoxy resin in the cavity 43 is thermally set by this series of temperature controls. Thereafter, the mold 4 is separated from a molded body and then its gate is cut off.

Figure 3:
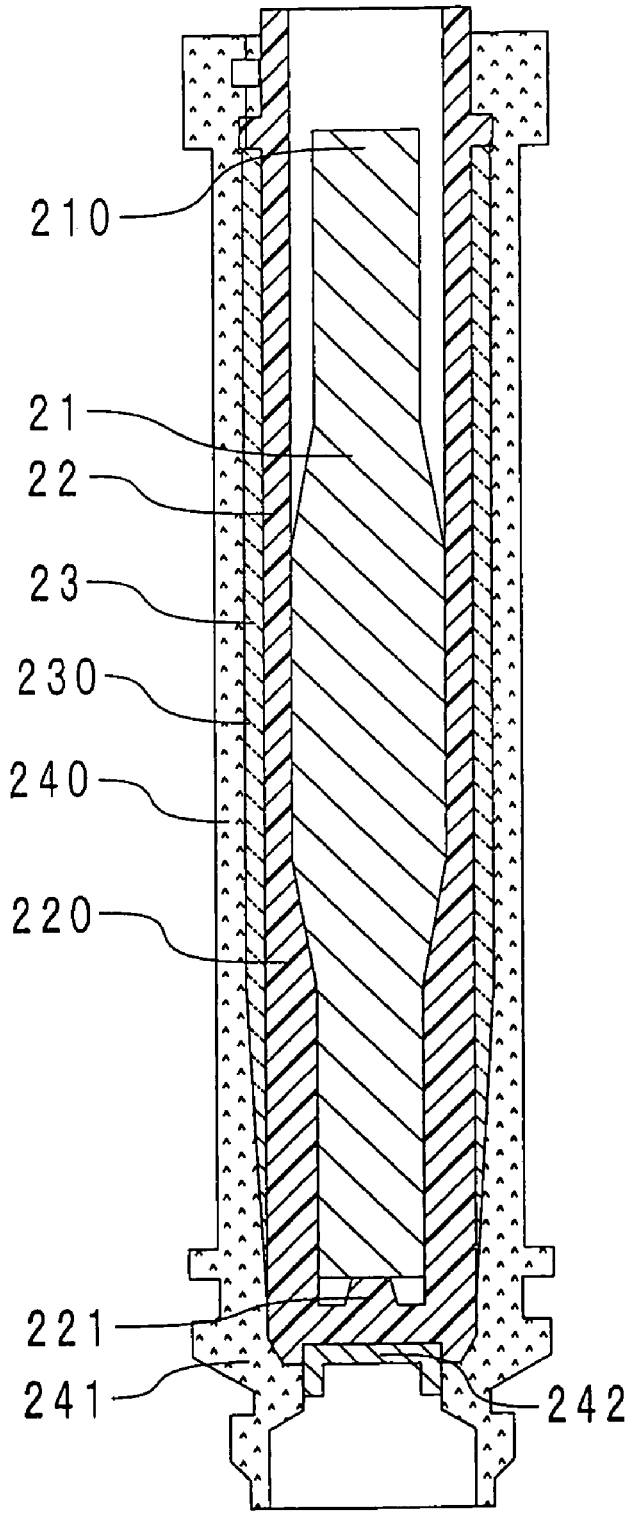
FIG. 3 is an axial cross-sectional view of a molded body after gate-cut in accordance with the first embodiment.

An axial cross-sectional view of the molded body after gate-cut is shown in FIG. 3. As shown in FIG. 3, the coil insulating resin material 230 and the primary spool 240 and the high voltage tower 241 are integrally manufactured of the cured injection molding epoxy resin. Moreover, the high voltage terminal 242 is fixed to the bottom portion 221 and the high voltage tower 241.

Figure 4:
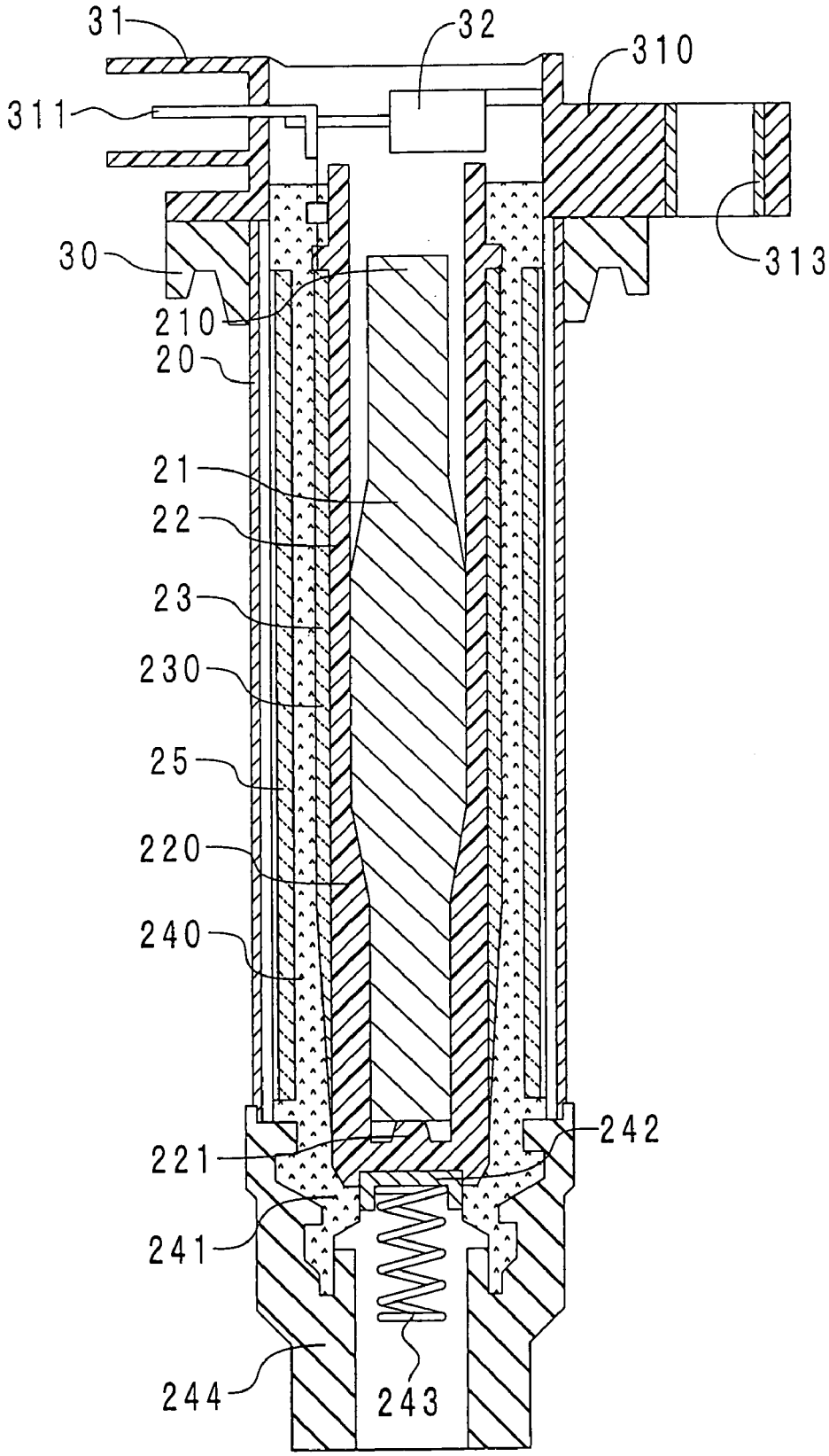
FIG. 4 is an axial cross-sectional view of a molded body mounted with other parts in accordance with the first embodiment of the present invention.

In this step, other parts are mounted on the molded body. An axial cross-sectional view of the molded body mounted with the other parts is shown in FIG. 4. The primary coils 25 are wound around the outer peripheral surface of the primary spool 240. The coil spring 243 is fixed to the high voltage terminal 242. Moreover, the plug cap 244 is put on the high voltage tower 241. The outer peripheral core 20 is put on the top of the plug cap 244. The seal ring 30 is annularly put on the outer peripheral surface of the top of the outer peripheral core 20. The previously assembled connector 31 is arranged on the outer peripheral core 20. The connector pins 311, the secondary coil 23, the primary coil 25 and the igniter 32 are connected to each other.

In the step of filling the insulating resin material into the connector, first, a previously prepared epoxy resin is filled from the top opening of the case 310 into the case 310. The molded body is heated and is held at a predetermined temperature pattern and then is cooled. The epoxy resin in the case 310 is thermally set by this series of temperature controls. In this manner, the case 310 is filled with the connector insulating resin material 312 shown in FIG. 1. The top opening of the case 310 is closed. The top end 210 of the center portion 21 is gripped.

Next, the effects of the ignition coil device 1 of this embodiment and the method of manufacturing the same will be described. According to the ignition coil device 1 of this embodiment, the coil insulating resin material 230 is filled into and cured in the spaces between the spaces between the secondary windings 23. The coil insulating resin material 230 is subjected to processing of removing bubbles in advance before it is filled into the mold 4. For this reason, the coil insulating resin material 230 is excellent in an insulating property and in a fixing property. Thus, according to the ignition coil device 1 of this embodiment, it is possible to ensure the insulation between the secondary windings 23 and the insulation between the secondary windings 23 and the primary coils 25. Then, it is possible to prevent the secondary windings 23 from losing their winding shape.

Further, according to the ignition coil device 1 of this embodiment, the connector insulating resin material 312 is filled into and cured in the case 310 of the connector 31. The connector insulating resin material 312 is subjected to a processing of removing bubbles in advance before it is filled into the case 310. For this reason, the connector insulating resin material 312 is inferior in the very insulating property to the coil insulating resin material 230 but is excellent in the fixing property. Thus, according to the ignition coil device 1 of this embodiment, it is possible to securely fix parts such as the connector pins 311, the igniter 32, a part for connecting the connecting pins 311 to the igniter 32, a part for connecting the connector pins 311 and the primary coil 25, and a part for connecting the connector pins 311 and the secondary coil 23.

Still further, according to the ignition coil device 1 of this embodiment, the connector insulating resin material 312 has a high percentage of content of voids. For this reason, it is possible to reduce the amount of use of the epoxy resin of its base material. Thus, it is possible to reduce the manufacturing cost of the ignition coil device.

Still further, according to the ignition coil device 1 of this embodiment, the coil insulating resin material 230 and the connector insulating resin material 312 are arranged separately from each other. For this reason, it is possible to independently perform the processing of removing bubbles from the coil insulating resin material 230 and the processing of removing bubbles from the connector insulating resin material 312. Thus, according to the ignition coil device 1 of this embodiment, it is easy to control the percentage of content of voids of each of the insulating resin materials.

Still further, according to the ignition coil device 1 of this embodiment, the coil insulating resin material 230, the primary spool 240 and the high voltage tower 241 are integrally molded of the same injection molding epoxy resin. On this account, it is possible to reduce the parts in number. Moreover, it is possible to reduce the outside diameter of the ignition coil device 1.

Still further, according to the ignition coil device 1 of this embodiment, the spaces between the primary coils 25 are not impregnated with the resin. Thus, it is possible to reduce the amount of use of resin by the amount to be used for the spaces. Therefore, it is possible to reduce the manufacturing cost of the ignition coil device 1.

Still further, the percentage of content of voids of the connector insulating resin material 312 is higher than the percentage of content of voids of the coil insulating resin material 230. For this reason, the Young's modulus of the connector insulating resin material 312 is smaller than the Young's modulus of the coil insulating resin material 230. Thus, this can increase the resistance to shock of the igniter 32.

Still further, according to the method of manufacturing the ignition coil device 1 of this embodiment, the coil insulating resin material 230 is filled into the spaces between the secondary windings 23 and then connector insulating resin material 312 is filled into the case 310. For this reason, both of the insulating resin materials are not mixed with each other. Thus, according to the manufacturing method of this embodiment, it is possible to manufacture the ignition coil device 1 having both of the coil insulating resin material 230 and the connector insulating resin material 312 with ease.

Still further, according to the method of manufacturing the ignition coil device 1 of this embodiment, the injection molding is used for the step of filling the insulating resin material into the spaces between the windings. The use of injection molding can make the time required to cure the resin comparatively short as compared with a case where the spaced are filled with the resin, for example, by vacuum-filling. Moreover, it is not required to evacuate the cavity 43 to a vacuum. For this reason, the productivity of the ignition coil device 1 can be increased. Moreover, the use of injection molding increases the fluidity of the resin in the cavity 43. Thus, it is possible to distribute the resin to all portions in the cavity 43. Moreover, it is possible to sufficiently impregnate the resin into the spaces between the secondary windings 23.

Still further, according to the mold 4 used in manufacturing the ignition coil device 1 of this embodiment, a gate is open in the top of the cavity 43. For this reason, the trace of the gate is formed on the top end portion of the primary spool 240. There is a fear that strain is generated on the trace of the gate by a residual stress generated when the gate is cut off. However, the top end portion of the primary spool 240 having the trace of the gate is protruded upward from the top of the secondary coil 23 and the top of the primary coil 25. For this reason, even if the strain is generated, it hardly causes dielectric breakdown.

Moreover, the top end portion of the primary spool 240 is comparatively separated from the combustion chamber of the engine. Thus, the top end portion of the primary spool 240 is less prone to suffering the effect of combustion heat. This further reduces possibility that the strain causes the dielectric breakdown.

Still further, according to the method of manufacturing the ignition coil device 1 of this embodiment, a filling mold is used for the step of filling the insulating resin material into the connector. The use of filling mold makes it hard for the connector insulating resin material 312 to flow. For this reason, the space 26 can be ensured with comparative ease. That is, it is comparatively easy to keep the center core 21 in no contact with the secondary spool body 220 on both sides in the radial direction of the space 26. Thus, it is possible to prevent the center core 21 from being put into contact with the secondary spool body 220 to produce a thermal stress in each of the parts. It is possible to prevent dielectric breakdown from being caused between the secondary coil 23 and the center core 21.

(Second Embodiment)

This embodiment and the first embodiment differ in that glass fibers of the same size are mixed and diffused in the coil insulating resin material and the connector insulating resin material. Further, the two embodiments differ in that the high voltage terminal is not arranged. Moreover, the embodiments differ in that the case is integrally molded with the connector insulating resin material.

Figure 5:
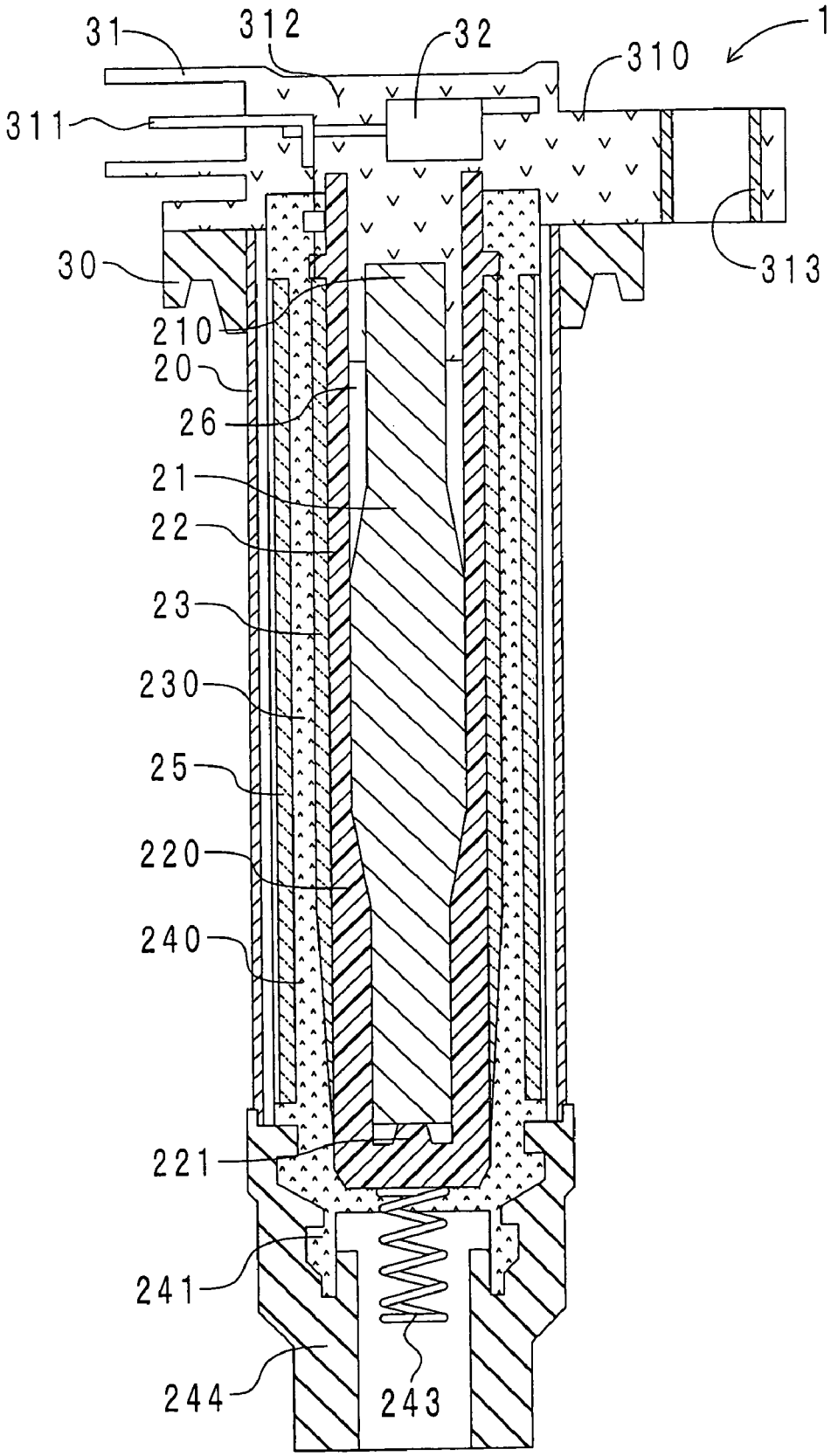
FIG. 5 is an axial cross-sectional view of an ignition coil device in accordance with a second embodiment of the present invention.

First, the construction of an ignition coil device of this embodiment will be described. An axial cross-sectional view of the ignition coil device of this embodiment is shown in FIG. 5. Here, parts corresponding to those in FIG. 1 are designated by the same reference symbols. As shown in FIG. 5, the case 310 and the connector insulating resin material 312 are integrally molded of the same epoxy resin. The connector insulating resin material 312 and the coil insulating resin material 230 include epoxy resin as a base material and glass fibers as a filling material. The size of the glass fiber in the connector insulating resin material 312 is the same as the size of the glass fiber in the coil insulating resin material 230. However, the percentage of content of the glass fiber in the connector insulating resin material 312 to the epoxy resin is set at a higher value than the percentage of content of the glass fiber in the coil insulating resin material 230 to the epoxy resin.

Moreover, the coil spring 243 is inserted into the high voltage tower 241. The coil spring 243 is connected to the secondary coil 23 not through the high voltage terminal.

Next, a method of manufacturing the ignition coil device of this embodiment will be described. In the step of filling the insulating resin material into the spaces between the windings, just as with the first embodiment, the coil insulating resin material 230 is filled. However, in place of the high voltage terminal 242 shown in FIG. 2, the coil spring 243 is arranged in the third mold 42.

Figure 6:
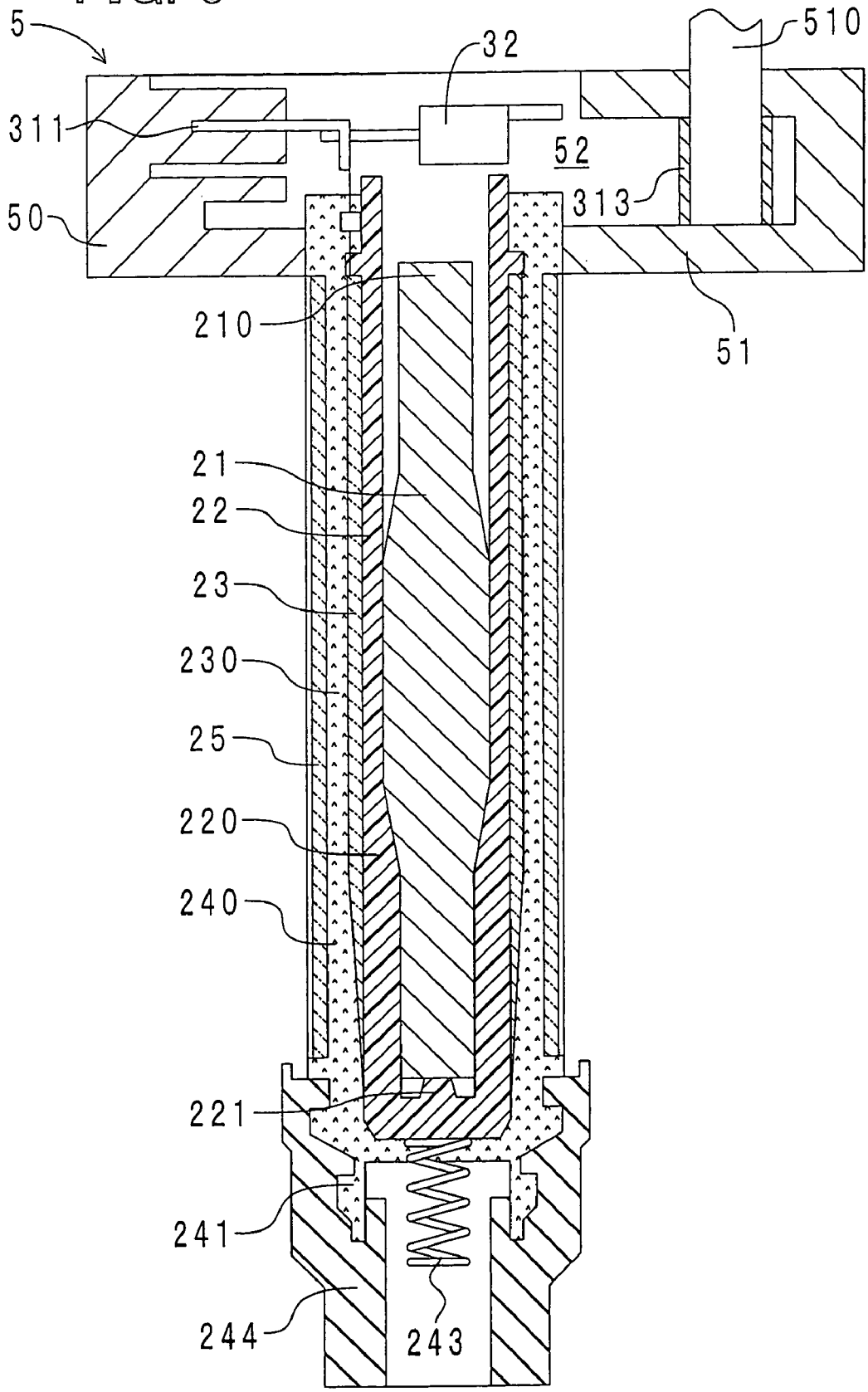
FIG. 6 is an axial cross-sectional view of a mold used in accordance with the second embodiment.

In the step of filling the insulating resin material into the connector, the case 310 and the connector insulating resin material 312 are molded at a time out of the same epoxy resin. FIG. 6 shows an axial cross-sectional view of a mold used in the step of filling the resin insulating into the connector. As shown in FIG. 6, a mold 5 includes a first mold 50 and a second mold 51. The inside surface of the mold 5 is formed in a shape symmetric with respect to the mold to the outside surface of the case. The connector pins 311 are supported on the inside surface of the first mold 50. The connector pins 311 are connected to the igniter 32, the primary coil 25 and the secondary coil 23. The igniter 32 is held in the cavity 52 by the connector pins 311 via this connecting part. A support pin 510 is passed through the top wall of the second mold 51. A collar 313 is annularly put on the support pin 510. That is, the collar 313 is held in the cavity 52 by the support pin 510.

In this step, first, the connector pins 311 to which the igniter 32 is previously connected are arranged in the inside surface of the first mold 50. The primary coil 25 and the secondary coil 23 are connected to the connector pins 311. The support pin 510 is inserted into the second mold 51 and the collar 313 is fixed.

Next, the first mold 50 and the second mold 51 are closed and the epoxy resin is filled from the top end opening of the mold 5. Next, the molded body is heated and held at a predetermined temperature pattern. The molded body is cooled. The epoxy resin in the mold 5 is thermally set by this series of temperature controls. In this manner, as shown in FIG. 5, the connector insulating resin material 312 and the case 310 are integrally molded and the top end portion 210 of the center core 21 is gripped. Here, the percentage of content of glass fiber of the epoxy resin is high. For this reason, the fluidity of the epoxy resin is low. Thus, a space 23 is formed below the connector insulating resin material 312.

Thereafter, the mold 5 is separated from the molded body. The outer peripheral core 20 is mounted on the outer peripheral side of the primary coil 25. The seal ring 30 is annularly mounted on the outer peripheral surface of the top end of the outer peripheral core 20. In this manner, the ignition coil device 1 of this embodiment is manufactured.

Next, the effects of the ignition coil device of this embodiment and the method of manufacturing the ignition coil device will be described. According to the ignition coil device 1 of this embodiment, the coil insulating resin material 230 is filled into and cured in the spaces between the secondary windings 23. The percentage of content of glass fiber of the coil insulating resin material 230 is low. For this reason, the fluidity of the coil insulating resin material 230 is high. Thus, according to the ignition coil device 1 of this embodiment, the coil insulating resin material 230 is distributed to all spaces between the secondary windings 23. For this reason, according to the ignition coil device 1 of this embodiment, it is possible to ensure the insulation between the secondary windings 23 and the insulation between the secondary windings 23 and the primary coils 25. Moreover, it is possible to prevent the secondary windings 23 from losing their winding shape.

Further, according to the ignition coil device 1 of this embodiment, the connector insulating resin material 312 is filled into and cured in the connector 31. The percentage of content of glass fiber of the connector insulating resin material 312 is high. For this reason, the fluidity of the connector insulating resin material 312 is low. Thus, according to the ignition coil device 1 of this embodiment, it is possible to securely fix parts such as the connector pins 311, the igniter 32, the connection part of the connector pins 311 and the igniter 32, the connection part of the connector pins 311 and the primary coil 25, and the connection part of the connector pins 311 and the secondary coil 23.

Since the fluidity of the connector insulating resin material 312 is low, the connector insulating resin material 312 does not flow down to the space 26. For this reason, the space 26 can be ensured with comparative ease. That is, the center core 21 can be comparatively easily held in no contact with the secondary spool body 220 on both sides in the radial direction of the space 26. Thus, it is possible to prevent a thermal stress from being produced in each of the parts. Then, it is possible to prevent the dielectric breakdown from being caused between the secondary windings 23 and the center core 21.

Further, the percentage of content of the glass fiber of the connector insulating resin material 312 is higher than the percentage of content of the glass fiber of the coil insulating resin material 230. For this reason, the coefficient of linear expansion of the connector insulating resin material 312 is smaller than the coefficient of linear expansion of the coil insulating resin material 230. Thus, the coefficient of linear expansion of the connector insulating resin material 312 can be brought closer to the coefficient of linear expansion of the mold resin of the igniter 32, as compared with a case where the coefficient of linear expansion of the connector insulating resin material 312 is equal to the coefficient of linear expansion of the coil insulating resin material 230. Namely, it is possible to prevent a thermal stress from being produced by the difference between the coefficient of linear expansion of the connector insulating resin material 312 and the coefficient of linear expansion of the mold resin of the igniter 32.

(Third Embodiment)

This embodiment and the first embodiment differ in that the primary spool and the high voltage tower are separately molded from the coil insulating resin material. Further, the two embodiments differ in that both of the coil insulating resin material and the connector insulating resin material are filled through the filled mold. That is, both of the insulating resin materials are molded out of the epoxy resin. Moreover, the embodiments differ in that glass fibers are mixed and diffused at the same percentage of content in both the insulating resin materials.

Figure 7:
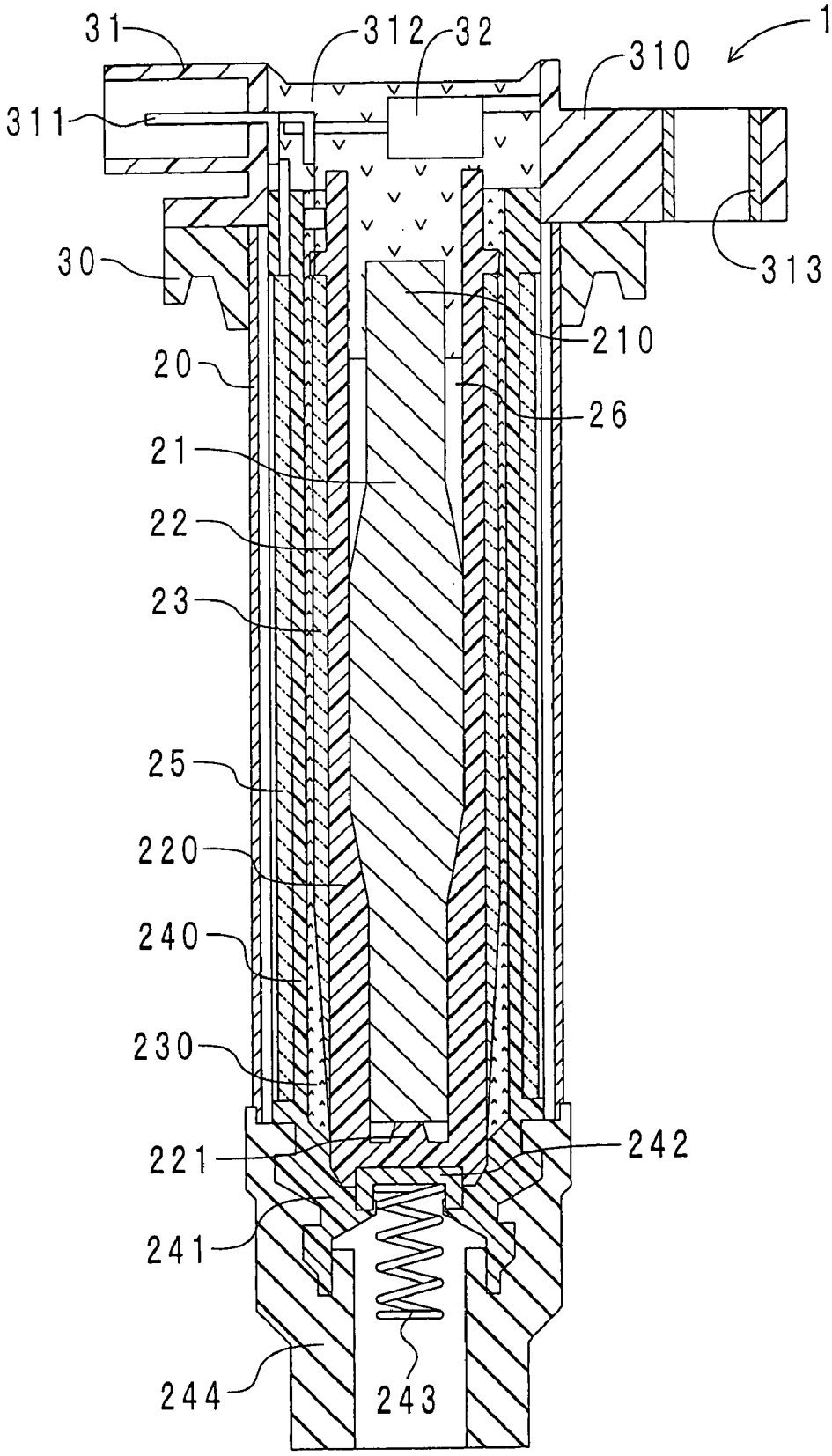
FIG. 7 is an axial cross-sectional view of an ignition coil device in accordance with a third embodiment of the present invention.

First, the construction of the ignition coil device of this embodiment will be described. FIG. 7 shows an axial cross-sectional view of the ignition coil device of this embodiment. Here, parts corresponding to those in FIG. 1 are designated by the same reference symbols. As shown in FIG. 7, the primary spool 240 and the high voltage terminal 241 are integrally molded by injection molding. However, the primary spool 240 and the high voltage terminal 241 are separately molded from the coil insulating resin material 230. The glass fibers are mixed and diffused at the same percentage of content in the coil insulating resin material 230 and in the connector insulating resin material 312. However, the glass fibers in the connector insulating resin material 312 are larger in axial length and in diameter than the glass fibers in the coil insulating resin material 230.

Next, a method of manufacturing an ignition coil device in accordance with this embodiment will be described. In the step of filling the insulating resin material between windings, first, solid parts other than the coil insulating resin material 230 and the connector insulating resin material 312 are mounted. Next, the epoxy resin is filled into the space between the secondary spool 22 and the primary spool 240 through the top end opening of the case 310.

In the step of filling the insulating resin material into connector, first, the epoxy resin is filled into the case 310 through the top end opening of the case 310. Next, the body into which two epoxy resins are filled is heated and held in a predetermined temperature pattern and then cooled. The epoxy resins are thermally cured by this series of temperature controls. The spaces between the secondary windings 23 are filled with the coil insulating resin material 230. The case 310 is filled with the connector insulating resin material 312. In this manner, the ignition coil device of this embodiment is manufactured.

Next, the effects of the ignition coil device of this embodiment and the method of manufacturing the same will be described. According to the ignition coil device 1 of this embodiment, the coil insulating resin material 230 is filled into and cured in the spaces between the secondary windings 23. The glass fibers in the coil insulating resin material 230 are small in size. For this reason, the fluidity of the coil insulating resin material 230 is high. Thus, according to the ignition coil device 1 of this embodiment, the coil insulating resin material 230 is distributed into all the portions between the secondary windings 23. For this reason, according to the ignition coil device 1 of this embodiment, it is possible to ensure the insulation between the secondary windings 23 and the insulation between the secondary coil 23 and the primary coil 25. Moreover, it is possible to prevent the secondary windings 23 from losing its winding shape.

Further, according to the ignition coil device 1 of this embodiment, the connector insulating resin material 312 is filled into and cured in the connector part 31. The glass fibers in the connector insulating resin material 312 are large in size. For this reason, the fluidity of the connector insulating resin material 312 is low. Thus, according to the ignition coil device 1 of this embodiment, it is possible to securely fix the parts such as the connector pins 311, the igniter 32, the connection part of the connector pins 311 and the igniter 32, the connection part of the connector pins 311 and the primary coil 25 and the connection part of the connector pins 311 and the secondary coil 23.

Further, since the fluidity of the connector insulating resin material 312 is low, the connector insulating resin material 312 does not flow down to the space 26. For this reason, the space 26 can be relatively easily ensured. That is, the center core 21 can be comparatively easily held in no contact with the secondary spool body 220 on both sides in the radial direction of the space 26. Thus, it is possible to prevent a thermal stress from being produced in each of the parts. Then, it is possible to prevent the dielectric breakdown from being caused between the secondary windings 23 and the center core 21.

Still further, according to the ignition coil device 1 of this embodiment, the coil insulating resin material 230 and the connector insulating resin material 312 are heat-treated at a time in the step of filling the insulating resin material into the connector. For this reason, it is possible to reduce the man-hours required to mount the ignition coil devices, as compared with a case where the coil insulating resin material 230 and the insulating resin material 312 are separately heat-treated.

(Fourth Embodiment)

This embodiment and the first embodiment differ in that a housing is arranged on the outer peripheral side of the outer peripheral core.

Figure 8:
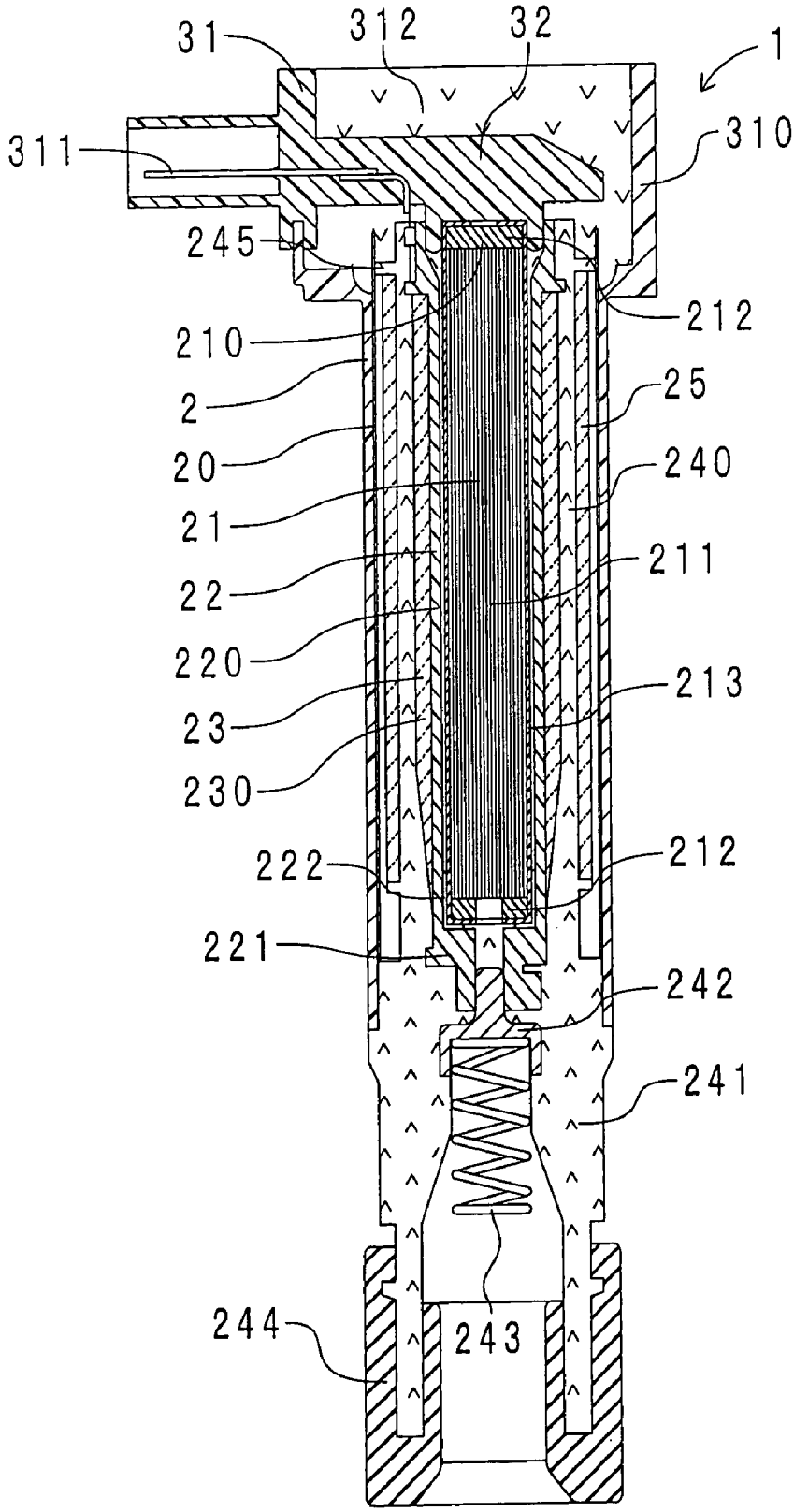
FIG. 8 is an axial cross-sectional view of an ignition coil device in accordance with a fourth embodiment of the present invention.

First, the construction of an ignition coil device in accordance with this embodiment will be described. FIG. 8 shows an axial cross-sectional view of an ignition coil device in accordance with this embodiment. Here, parts corresponding to those in FIG. 1 are designated by the same reference symbols. The seal ring 30 and the collar 313 in FIG. 1 are omitted in FIG. 8.

As shown in FIG. 8, a housing 2 is molded of resin and in the shape of a cylinder. Parts of the center core 21, the secondary spool 22, the secondary windings 23, primary spool 240, the primary coils 25, and the outer peripheral core 20 are arranged in a coaxial manner inside the housing 2 in this order from the center to the outside in the radial direction. The center core 21 includes a core body 211, elastic parts 212 and a tube 213. The core body 211 is formed by laminating silicon steel rectangular plates having different widths. The core body 211 is formed in the shape of a round bar. The elastic part 212 is made of silicone and is formed in the shape of a short cylinder.

A total of two elastic parts 212 are arranged on the top and bottom of the core body 211. The tube 213 covers the core body 211 and the two elastic parts 212 from the outer peripheral side. The case 310 is integrally molded on the top end of the housing 2. The high voltage tower 241 is arranged below the housing 2. The high voltage tower 241, the primary spool 240 and the coil insulating resin material 230 are integrally molded of the same injection molding epoxy resin.

A flange 245 is molded on the outer peripheral surface on the top end of the primary spool 240. The flange 245 abuts against the inner peripheral surface of the outer peripheral core 20. A portion of the flange 245 is inserted also into a slit made in the outer peripheral core 20. The flange 245 separates the inside of the case 310 from the space between the outer peripheral surface of the primary spool 240 and the inner peripheral surface of the outer peripheral core 20. Here, the injection molding epoxy resin is filled also into the space between the outer peripheral surface of the tube 213 and the inner peripheral surface of the secondary spool 22. The high voltage terminal 242 and the coil spring 243 are arranged inside the high voltage tower 241. The plug cap 244 is put on the bottom end portion of the high voltage tower 241.

Figure 9:
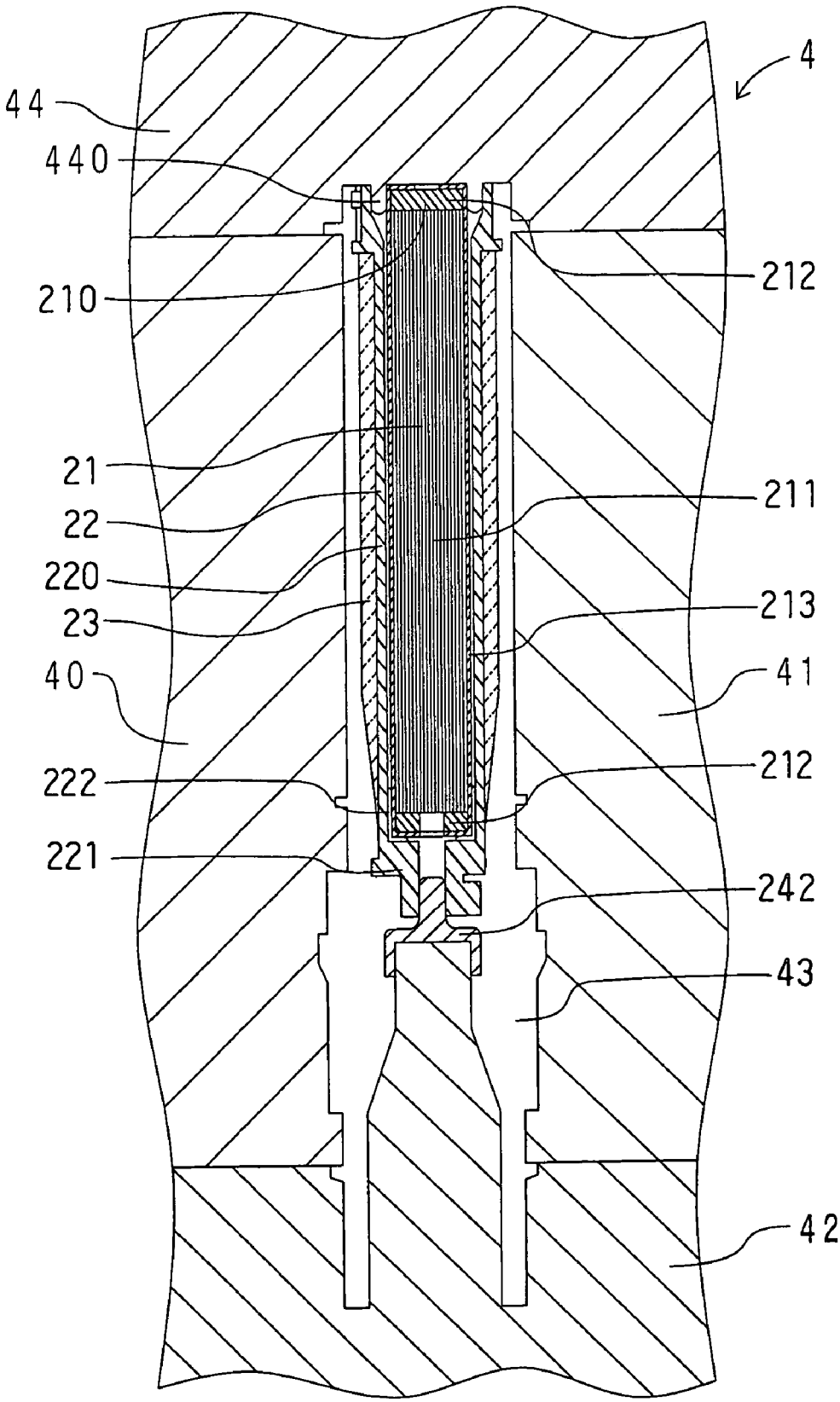
FIG. 9 is an axial cross-sectional view of a mold used in accordance with the fourth embodiment.

Next, a method of manufacturing the ignition coil device 1 in accordance with this embodiment will be described. The method of manufacturing the ignition coil device 1 in accordance with this embodiment has the step of filling the insulating resin material into the spaces between windings and the step of filling the insulating resin material into connector. In the process of filling the insulating resin material into the spaces between windings, first, the secondary spool is placed in the cavity of the mold. FIG. 9 shows an axial cross-sectional view of the mold. Here, parts corresponding to those in FIG. 2 are designated by the same reference symbols. As shown in FIG. 9, a mold 4 includes a first mold 40, a second mold 41, a third mold 42 and a fourth mold 44. The inside surface of the mold 4 is formed in the shape symmetric with respect to mold to the outside surfaces of the primary spool and the high voltage tower.

The secondary spool 22 previously injection-molded is placed in the cavity 43 of the mold 4. The secondary coil 23 is wound around the outer peripheral surface of the spool body 220. The high voltage terminal 242 supported by the third mold 42 is inserted into the bottom end opening of the bottom portion 221. The high voltage terminal 242 is previously connected to the secondary coil 23. The previously assembled center core 21 is inserted into the inner peripheral side of the secondary spool 22. The bottom end of the center core 21 is positioned by a support rib 222 which is shaped like a letter L and is formed around the inner peripheral surface of the bottom portion 221. On the other hand, a top end portion 210 is positioned by the inner peripheral surface of a ring rib 440 protruding from the inside surface of the fourth mold 44.

The bottom of the secondary spool 22 is supported by the third mold 42 via the high voltage terminal 242. On the other hand, the top of the secondary spool 22 is supported by the outer peripheral surface of the ring rib 440 of the fourth mold 44. In this manner, the secondary spool 22 is fixed in the cavity 43. A space is formed between the outer peripheral surface of the tube 213 and the inner peripheral surface of the secondary spool 22.

In this step, next, the previously prepared injection molding epoxy resin is filled into the cavity 43 through the gate (not shown) formed in the top of the cavity 43 from the nozzle of an injection molding machine (not shown). The injection molding epoxy resin is distributed into all the portions in the cavity 43 by injection molding pressure. At this time, the injection molding epoxy resin is impregnated also into the spaces between the secondary windings 23. The injection molding epoxy resin is flowed also into the spaces between the outer peripheral surface of the tube 213 and the inner peripheral surface of the secondary spool 22.

Figure 10:
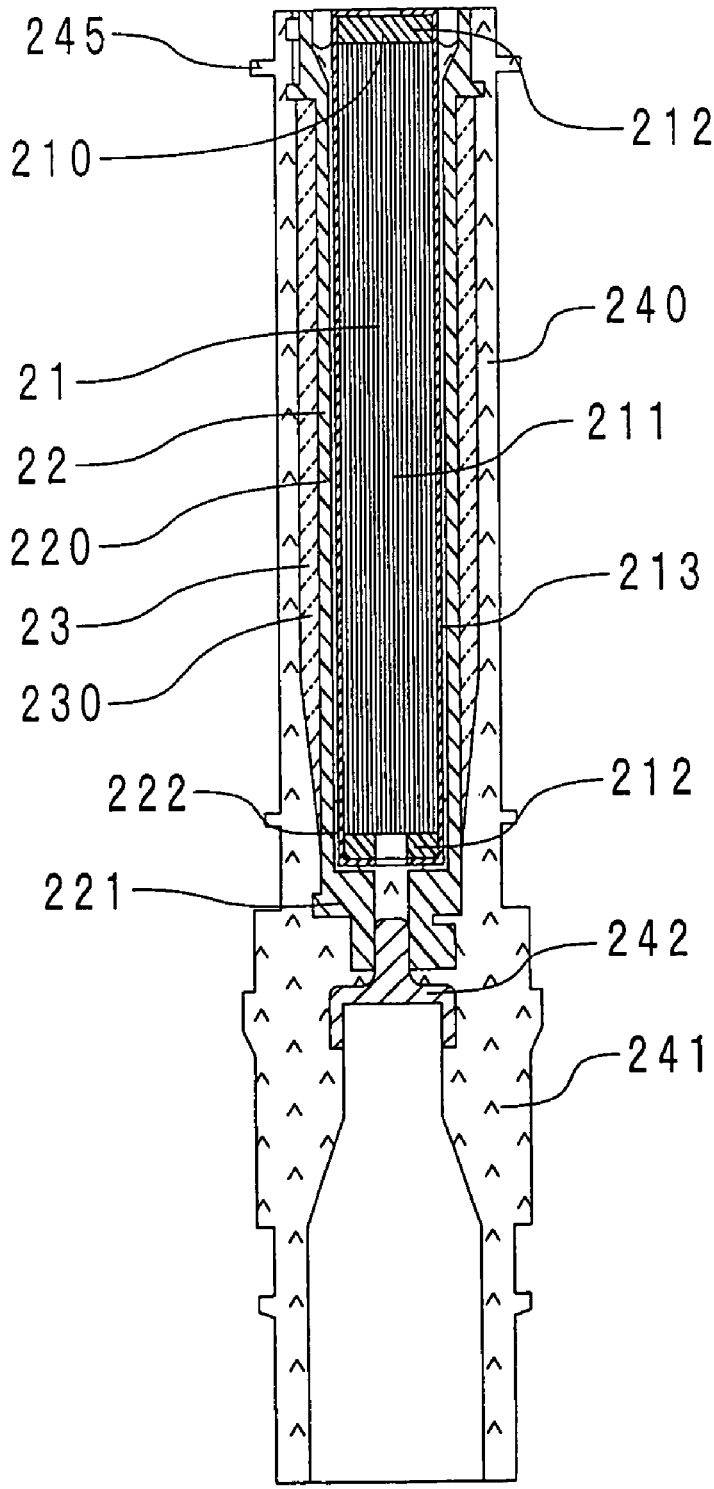
FIG. 10 is an axial cross-sectional view of a molded body after gate-cut in accordance with the fourth embodiment.

In this step, next, the cavity 43 is heated and held in a predetermined temperature pattern. The cavity 43 is cooled. The injection molding epoxy resin in the cavity 43 is thermally cured by this series of temperature controls. Thereafter, the mold 4 is separated from the molded body. The gate is cut off. FIG. 10 shows an axial cross-sectional view of the molded body after gate-cut. Here, parts corresponding to those in FIG. 3 are designated by the same reference symbols. As shown in FIG. 10, the coil insulating resin material 230, the primary spool 240 and the high voltage tower 241 are integrally molded of the cured injection molding epoxy resin. The injection molding epoxy resin is between the outer peripheral surface of the tube 213 and the inner peripheral surface of the secondary spool 22. The high voltage terminal 242 is fixed to the bottom portion 221 and the high voltage tower 241.

Figure 11:
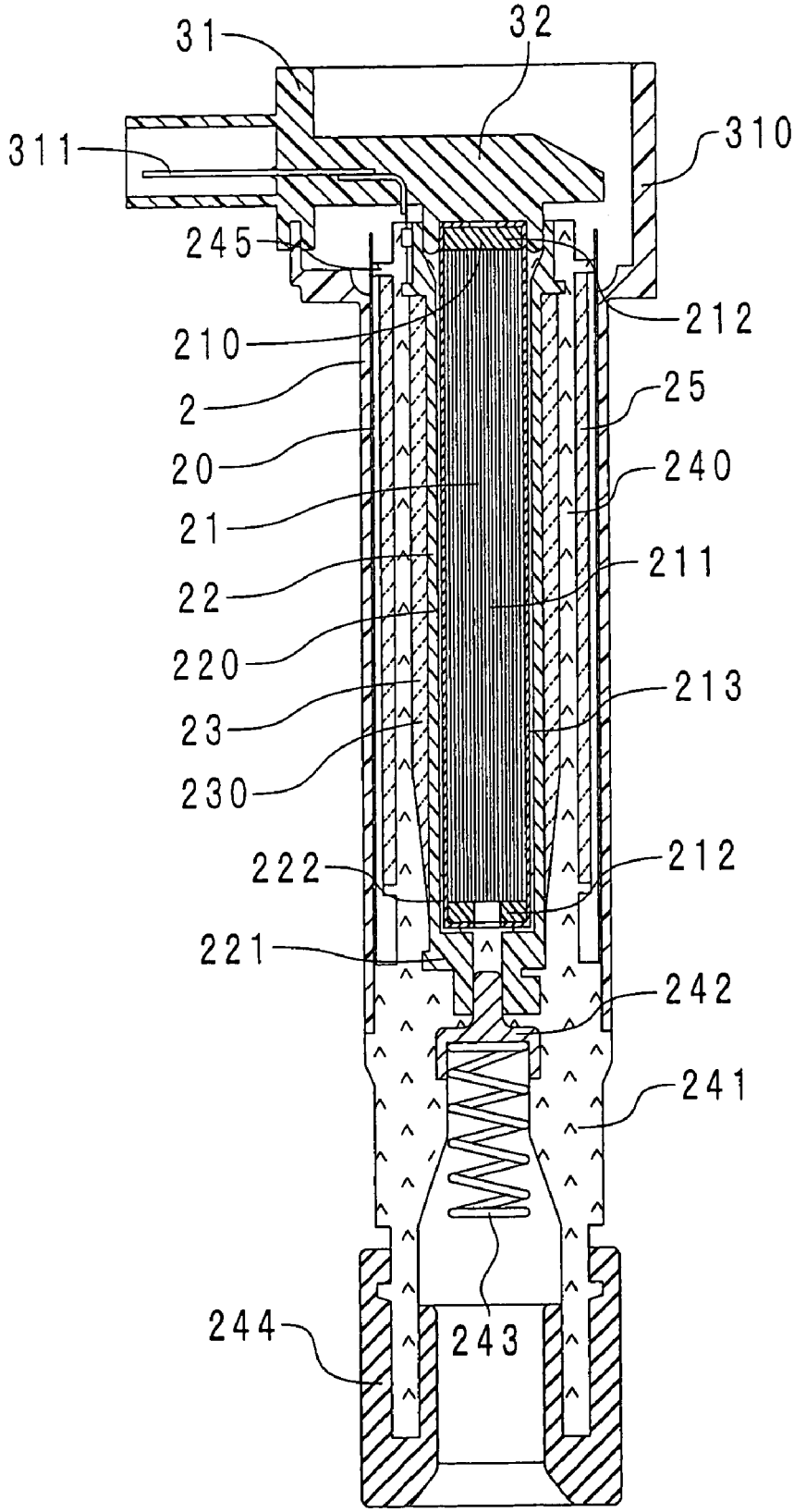
FIG. 11 is an axial cross-sectional view of a molded body mounted with other parts in in accordance with the fourth embodiment.

In this step, thereafter, other parts are mounted on this molded body. FIG. 11 shows an axial cross-sectional view of the molded body mounded with the other parts. Here, parts corresponding to those in FIG. 4 are designated by the same reference symbols. The primary coil 25 is wound around the outer peripheral surface of the primary spool 240. The coil spring 243 is fixed to the high voltage tower 242. The plug cap 244 is put on the high voltage tower 241. The outer peripheral core 20 and the housing 2 are put on the high voltage tower 214. The previously assembled connector 31 is placed on the top of the housing 2. The connector pins 311 are connected to the secondary coil 23, the primary coil 25, and the igniter 32.

In the step of filling the insulating resin material into connector, first, epoxy resin is filled from the top end opening of the case 310. At this time, the inside of the case 310 is separated from the space between the outer peripheral surface of the primary spool 240 and the inner peripheral surface of the outer peripheral core 20 by the flange 245. Thus, as shown in FIG. 8, the spaces between the primary coils 25 are not impregnated with the epoxy resin.

In this step, next, the molded body is heated and held in a predetermined temperature pattern. The molded body is cooled. The epoxy resin in the case 310 is cured by this series of temperature controls. In this manner, the connector insulating resin material 312 shown in FIG. 8 is filled. The top end opening of the case 310 is closed. In this manner, the ignition coil device 1 in accordance with this embodiment is manufactured.

Next, the effects of the ignition coil device 1 in accordance with this embodiment and the method of manufacturing the same will be described. According to the ignition coil device 1 in accordance with this embodiment and the method of manufacturing the same, the effects produced in the first embodiment can be produced.

According to the ignition coil device 1 in accordance with this embodiment, the spaces between the outer peripheral surface of the tube 213 and the inner peripheral surface of the secondary spool 22 are also impregnated with the injection molding epoxy resin. For this reason, it is possible to reliably ensure the insulation between the core body 211 and the secondary windings 23.

(Fifth Embodiment)

This embodiment and the fourth embodiment differ in that glass particles of the same size are mixed and diffused in the coil insulating resin material and the connector insulating resin material. Further, the two embodiments differ in that the primary spool is arranged separately from the coil insulating resin material. Hence, only these points of difference will be described here.

Figure 12:
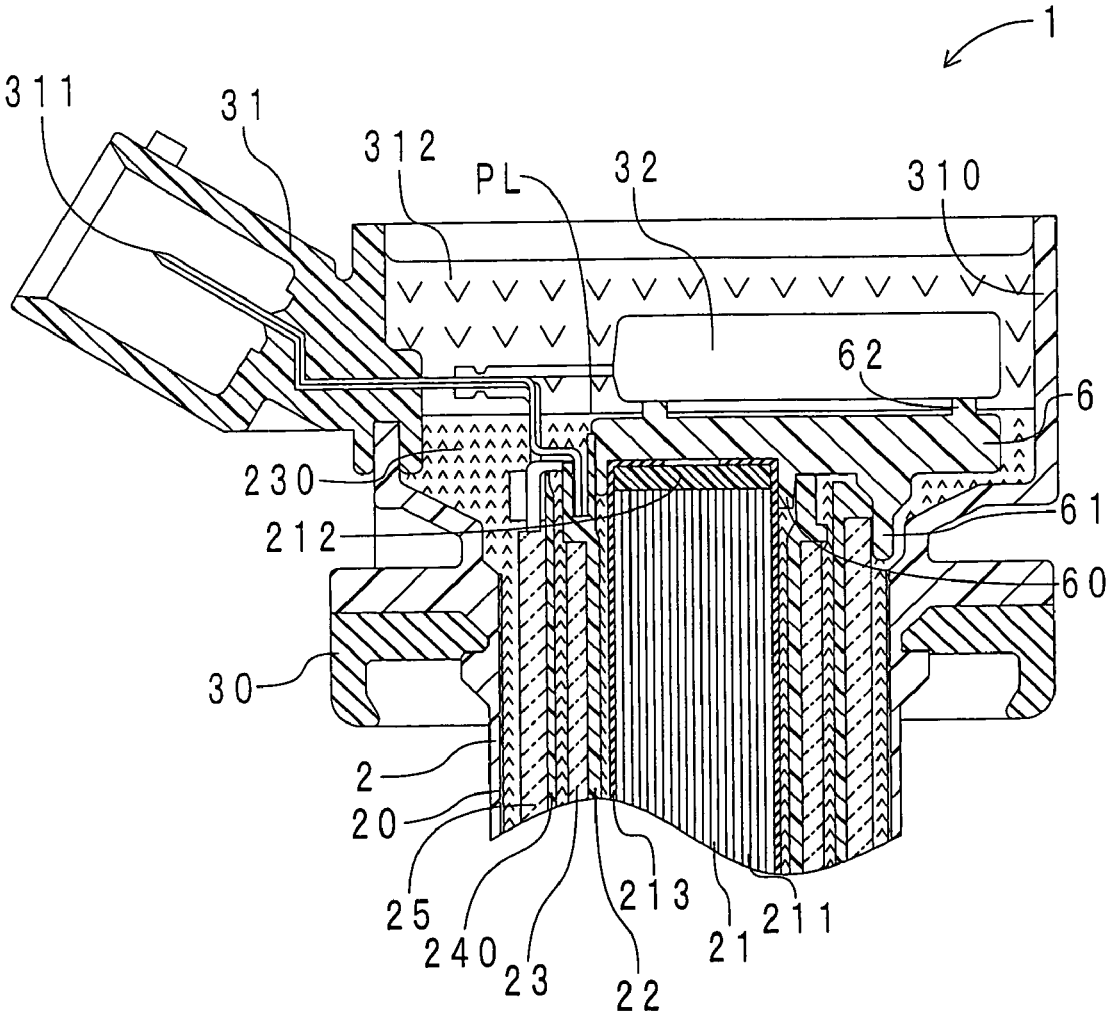
FIG. 12 is an enlarged view near a connector of an ignition coil device in accordance with a fifth embodiment of the present invention.
Figure 13:
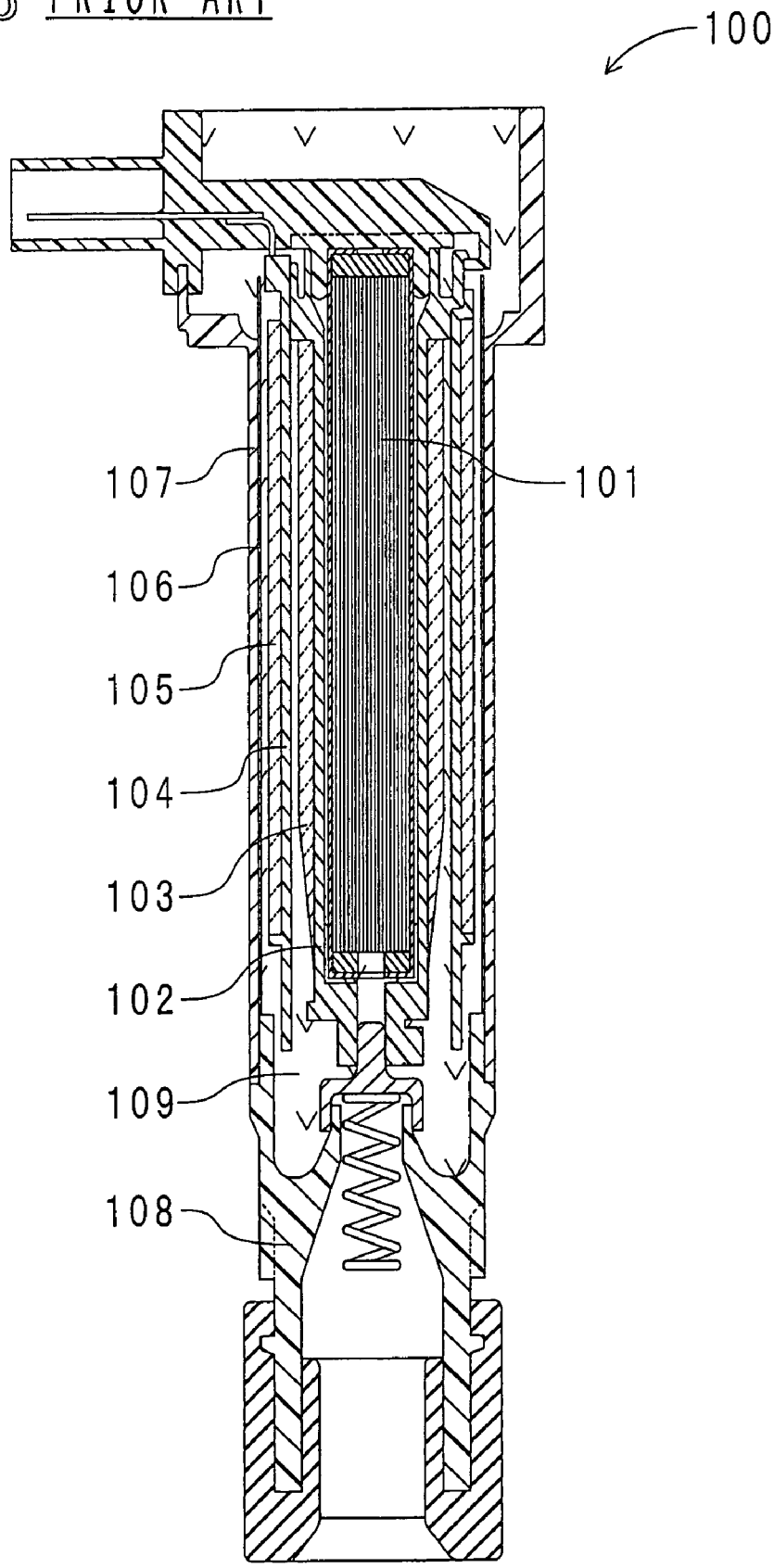
FIG. 13 PRIOR ART
FIG. 13 is an axial cross-sectional view of a conventional ignition coil device.

FIG. 12 shows an enlarged view of a portion near the connector of an ignition coil device in accordance with this embodiment. Here, parts corresponding to those in FIG. 1 and FIG. 8 are designated by the same reference symbols. The spaces between the center core and the secondary spool and the spaces between the primary coil and the housing are also impregnated with the coil insulating resin material. However, even if these portions are not impregnated with the coil insulating resin material, it is no problem.

As shown in the figure, a holder 6 which is formed out of resin and in the shape of a plate is interposed between the center core 21 and the igniter 32. An inside peripheral rib 60 and an outside peripheral rib 61 are formed in a manner protruded from the bottom surface of the holder 6. The center core 21 and the secondary spool 22 are centered by the inside peripheral rib 60. The primary spool 240 is centered by the outside peripheral rib 61. On the other hand, a protrusion 62 is formed on the top surface of the holder 6. The igniter 32 is placed on the protrusion 62. The coil insulating resin material 230 is filled into a portion below a dividing line PL in the case 2. On the other hand, the connector insulating resin material 312 is filled into a portion above the dividing line PL in the case 2. The percentage of content of glass particle of the connector insulating resin material 312 is set at a higher value than the percentage of content of glass particles of the coil insulating resin material 230. The percentage of content of voids of the connector insulating resin material 312 is set at a higher value than the percentage of content of glass particles of the coil insulating resin material 230.

According to the ignition coil device 1 in accordance with this embodiment and the method of manufacturing the same, the effects produced in the first embodiment can be produced. Moreover, the difference in the percentage of content of glass particle makes the coefficient of linear expansion of the connector insulating resin material 312 smaller than the coefficient of linear expansion of the coil insulating resin material 230. Namely, the coefficient of linear expansion of the connector insulating resin material 312 is adjusted to a value close to the coefficient of linear expansion of the mold resin of the igniter 32. For this reason, it is possible to prevent a thermal stress from being produced by the difference between the coefficient of linear expansion of the connector insulating resin material 312 and the coefficient of linear expansion of the mold resin of the igniter 32.

Further, the difference in the percentage of voids makes the Young's modulus of the connector insulating resin material 312 smaller than the Young's modulus of the coil insulating resin material 230. For this reason, the igniter 32 is surrounded by the comparatively soft connector insulating resin material 312. Thus, this increases the resistance to shock of the igniter 32.

(Other Embodiments)

The preferred embodiments of the ignition coil device of the invention and the method of manufacturing the same have been described above. However, it is not intended to limit the invention to these embodiments, but the invention can be put into practice in various modified embodiments and improved embodiments.

For example, while the case 310 and the connector insulating resin material 312 are integrally molded in the second embodiment, further, also the mold resin of the igniter 32 can be integrally molded. This can further reduce the parts in number and hence reduce assembling man-hours.

Further, while the spaces between the primary coils 25 are not impregnated with the resin in the above embodiments, they can be impregnated with the resin. This can prevent the primary coils 25 from losing its winding shape and improve heat radiation from the primary coils 25.

Still further, while the injection molding epoxy resin and the filling resin are used for the coil insulating resin material 230 and the connector insulating resin material 312, the resin is not especially limited in its kind. For example, resin whose base material is other than the epoxy resin can be used. Moreover, resin including fillers other than glass fibers and glass particles can be used. In this case, the base material of the coil insulating resin material 230 can be different from the base material of the connector insulating resin material 312. The filler can be different between the resins. Moreover, an insulating resin material having no filler can be used.

The filler is not especially limited in its shape. For example, fillers of all kinds of shapes such as ball, fiber, and foil can be used. If an insulating resin material includes foil-shaped fillers or foil-shaped fillers, its fluidity increases. Conversely, if an insulating resin material includes fiber-shaped fillers, its fluidity decreases. For this reason, it is recommended that the coil insulating resin material 230 and the connector insulating resin material 312 are mixed with a plurality of different shapes and kinds of fillers in an appropriate combination to adjust their fluidities.

Further, the foil-shaped filler is large in a surface area relative to mass and hence resists sinking at the time of filling. Thus, the use of resin including the foil-shaped fillers can prevent the fillers from being unevenly distributed in the direction of gravity after the resin is cured.

Still further, while the gate is formed in the top of the cavity 43, the gate is not especially limited in its position. The gate is not especially limited in its kind, either. For example, a film gate and a ring gate can be used.

Still further, while the center core 21 is previously placed inside the secondary spool 22 before closing the mold in the above embodiments, the core center 21 may be placed after the mold is separated.

Still further, the coil insulating resin material 230 and the connector insulating resin material 312 are not especially limited in the method of filling, either. These resins may be filled not only by the injection molding and the filling, but also by a transfer molding, for example.

Still further, the holder 6 is interposed between the center core 21 and the igniter 32 in the fifth embodiment (FIG. 12). However, the holder may not be necessarily interposed. That is, it is also recommended to support the igniter 32 in a manner of cantilever by welding it to the connector pins 311. This can reduce the parts in number and improve workability at the time of filling the coil insulating resin material 230 into the case 2.

What is claimed is:

1. An ignition coil device comprising:

a cylindrical secondary spool;

a secondary coil wound around an outer peripheral surface of the secondary spool;

a coil insulating resin material that is filled into spaces between secondary windings of the secondary coil;

a primary spool arranged on an outer peripheral side of secondary coil;

a primary coil wound around an outer peripheral surface of the primary spool;

a connector that is arranged on one end side in an axial direction of these parts and has a connector terminal electrically connected to the primary coil and the secondary coil; and a resin insulting material for connector that is filled into the connector, wherein the coil insulating resin material has a base material which is the same as or different from a base material of the connector insulating resin material, and wherein the coil insulating resin material is separately arranged from the connector insulating resin material.

2. The ignition coil device as claimed in claim 1, wherein the ignition coil device is free of insulating resin material other than the coil insulating resin material and the connector insulating resin material.

3. The ignition coil device as claimed in claim 1, wherein the connector insulating resin material has the percentage of content of voids higher than the percentage of content of voids of the coil insulating resin material.

4. The ignition coil device as claimed in claim 1, wherein at least one of the base material of the coil insulating resin material and the base material of the connector insulating resin material is epoxy resin.

5. The ignition coil device as claimed in claim 1, wherein fillers are distributed in the base material of the coil insulating resin material and in the base material of the connector insulating resin material, and wherein the percentage of content of the fillers relative to the base material of the connector insulating resin material is higher than the percentage of content of the fillers relative to the base material of the coil insulating resin material.

6. The ignition coil device as claimed in claim 5, wherein the percentage of content of the filler of the connector insulating resin material is 55% or more by weight in a case where the whole connector insulating resin material is 100% by weight, and wherein the percentage of content of the fillers of the coil insulating resin material is less than 55% by weight in a case where the whole coil insulating resin material is 100% by weight.

7. The ignition coil device as claimed in claim 5, wherein the fillers are inorganic fillers including one element selected from the group consisting of crystalline silica, mica, talc, fused silica, and alumina.

8. The ignition coil device as claimed in claim 1, wherein fillers are distributed in the base material of the coil insulating resin material and the base material of the connector insulating resin material, and wherein the fillers of the connector insulating resin material are larger in size than the fillers of the coil insulating resin material.

9. The ignition coil device as claimed in claim 8, wherein the fillers are inorganic fillers including one element selected from the group consisting of crystalline silica, mica, talc, fused silica, and alumina.

10. The ignition coil device as claimed in claim 1, wherein fillers are diffused only in the base material of the connector insulating resin material.

11. The ignition coil device as claimed in claim 10, wherein the fillers are inorganic fillers including one element selected from the group consisting of crystalline silica, mica, talc, fused silica, and alumina.

12. The ignition coil device as claimed in claim 1, wherein a coefficient of linear expansion of the connector insulating resin material is smaller than a coefficient of linear expansion of the coil insulating resin material.

13. The ignition coil device as claimed in claim 1, wherein a coefficient of linear expansion of the connector insulating resin material is not less than 11 ppm/° C. and less than 40 ppm/° C.

14. The ignition coil device as claimed in claim 1, wherein Young's modulus of the connector insulating resin material is smaller than Young's modulus of the coil insulating resin material.

15. The ignition coil device as claimed in claim 1, wherein Young's modulus of the connector insulating resin material is less than 8200 MPa.

16. The ignition coil device as claimed in claim 1, wherein an igniter is arranged in the connector insulating resin material.

17. The ignition coil device as claimed in claim 16, wherein the igniter is held by the connector terminal and is positioned in the connector insulating resin material.

18. The ignition coil device as claimed in claim 16, wherein the igniter is positioned in the connector insulating resin material by a protrusion formed on a top of a holder for centering the secondary spool.

19. An ignition coil device comprising:

a cylindrical secondary spool;

a secondary coil wound around an outer peripheral surface of the secondary spool;

a coil insulating resin material that is filled into spaces between secondary windings of the secondary coil;

a primary spool arranged on an outer peripheral side of secondary coil;

a primary coil wound around an outer peripheral surface of the primary spool;

a connector that is arranged on one end side in an axial direction of these parts and has a connector terminal electrically connected to the primary coil and the secondary coil; and a resin insulting material for connector that is filled into the connector, wherein the coil insulating resin material has a base material which is the same as or different from a base material of the connector insulating resin material, and wherein the connector insulating resin material has the percentage of content of voids higher than the percentage of content of voids of the coil insulating resin material.

20. An ignition coil device comprising:

a cylindrical secondary spool;

a secondary coil wound around an outer peripheral surface of the secondary spool;

a coil insulating resin material that is filled into spaces between secondary windings of the secondary coil;

a primary spool arranged on an outer peripheral side of secondary coil;

a primary coil wound around an outer peripheral surface of the primary spool;

a connector that is arranged on one end side in an axial direction of these parts and has a connector terminal electrically connected to the primary coil and the secondary coil; and a resin insulting material for connector that is filled into the connector, wherein the coil insulating resin material has a base material which is the same as or different from a base material of the connector insulating resin material, and wherein a coefficient of linear expansion of the connector insulating resin material is smaller than a coefficient of linear expansion of the coil insulating resin material.

21. An ignition coil device comprising:

a cylindrical secondary spool;

a secondary coil wound around an outer peripheral surface of the secondary spool;

a coil insulating resin material that is filled into spaces between secondary windings of the secondary coil;

a primary spool arranged on an outer peripheral side of secondary coil;

a primary coil wound around an outer peripheral surface of the primary spool;

a connector that is arranged on one end side in an axial direction of these parts and has a connector terminal electrically connected to the primary coil and the secondary coil; and a resin insulting material for connector that is filled into the connector, wherein the coil insulating resin material has a base material which is the same as or different from a base material of the connector insulating resin material, and wherein a coefficient of linear expansion of the connector insulating resin material is not less than 11 ppm/° C. and less than 40 ppm/° C.

22. An ignition coil device comprising:

a cylindrical secondary spool;

a secondary coil wound around an outer peripheral surface of the secondary spool;

a coil insulating resin material that is filled into spaces between secondary windings of the secondary coil;

a primary spool arranged on an outer peripheral side of secondary coil;

a primary coil wound around an outer peripheral surface of the primary spool;

a connector that is arranged on one end side in an axial direction of these parts and has a connector terminal electrically connected to the primary coil and the secondary coil; and a resin insulting material for connector that is filled into the connector, wherein the coil insulating resin material has a base material which is the same as or different from a base material of the connector insulating resin material, and wherein Young's modulus of the connector insulating resin material is smaller than Young's modulus of the coil insulating resin material.

23. An ignition coil device comprising:

a cylindrical secondary spool;

a secondary coil wound around an outer peripheral surface of the secondary spool;

a coil insulating resin material that is filled into spaces between secondary windings of the secondary coil;

a primary spool arranged on an outer peripheral side of secondary coil;

a primary coil wound around an outer peripheral surface of the primary spool;

a connector that is arranged on one end side in an axial direction of these parts and has a connector terminal electrically connected to the primary coil and the secondary coil; and a resin insulting material for connector that is filled into the connector, wherein the coil insulating resin material has a base material which is the same as or different from a base material of the connector insulating resin material, and wherein Young's modulus of the connector insulating resin material is less than 8200 MPa.

24. An ignition coil device comprising:

a cylindrical secondary spool;

a secondary coil wound around an outer peripheral surface of the secondary spool;

a coil insulating resin material that is filled into spaces between secondary windings of the secondary coil;

a primary spool arranged on an outer peripheral side of secondary coil;

a primary coil wound around an outer peripheral surface of the primary spool;

a connector that is arranged on one end side in an axial direction of these parts and has a connector terminal electrically connected to the primary coil and the secondary coil; and a resin insulting material for connector that is filled into the connector, wherein the coil insulating resin material has a base material which is different from a base material of the connector insulating resin material.

25. The ignition coil device as claimed in claim 24, wherein the coil insulating resin material is filled before the connector insulating resin material is filled.

26. The ignition coil device as claimed in claim 24, wherein the connector insulating resin material is further filled in a space between a central core and either one of the secondary spool or the primary spool.

* * * * *